US007714221B2

(12) United States Patent
Ishioka

(10) Patent No.: US 7,714,221 B2
(45) Date of Patent: May 11, 2010

(54) BOOKLET PAGE TURNING APPARATUS

(75) Inventor: Yukinobu Ishioka, Utsunomiya (JP)

(73) Assignee: Kabuhsiki Kaisha Toshiba, Tokyo (JP)

( * ) Notice: Subject to any disclaimer, the term of this patent is extended or adjusted under 35 U.S.C. 154(b) by 0 days.

(21) Appl. No.: 12/429,577

(22) Filed: Apr. 24, 2009

(65) Prior Publication Data

US 2009/0266224 A1 Oct. 29, 2009

(30) Foreign Application Priority Data

Apr. 25, 2008 (JP) ..... 2008-115890
Apr. 14, 2009 (JP) ..... 2009-098276

(51) Int. Cl.
*G10G 7/00* (2006.01)

(52) U.S. Cl. ..... 84/519
(58) Field of Classification Search ..... 84/486–520
See application file for complete search history.

(56) References Cited

U.S. PATENT DOCUMENTS 5,233,900 A * 8/1993 Fitzgerald ..... 84/497
5,806,991 A 9/1998 Hubler

FOREIGN PATENT DOCUMENTS

JP 06-305278 11/1994
JP 2005-144756 6/2005

* cited by examiner

*Primary Examiner*—Kimberly R Lockett
(74) *Attorney, Agent, or Firm*—Pillsbury Winthrop Shaw Pittman, LLP

(57) ABSTRACT

A page turning apparatus having a vacuum pad to vacuum suck the uppermost page of a booklet, a drive link plate to move the vacuum pad to pick up the uppermost page of a booklet at a predetermined angle in the direction of opening around a bound edge, a pinch-roller which goes under the uppermost page picked up at a predetermined angle, and a control unit which releases the vacuum suction of the vacuum pad, and moves the vacuum pad in the direction retreating from the uppermost page, after the pinch-roller goes under the uppermost page, and conveys a booklet so that the uppermost page is brought into contact with the pinch-roller, and opened.

6 Claims, 45 Drawing Sheets

FIG. 45A
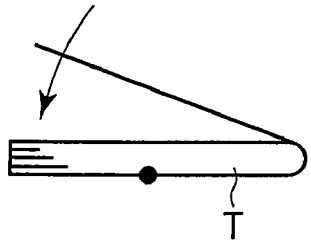
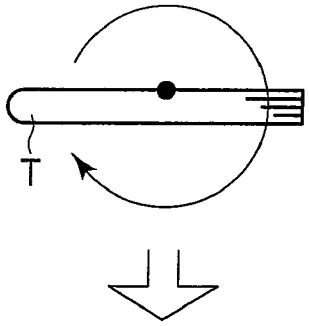
FIG. 45B
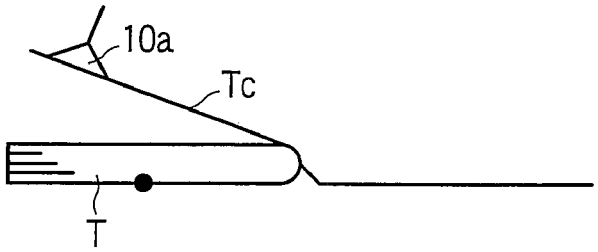
FIG. 46A
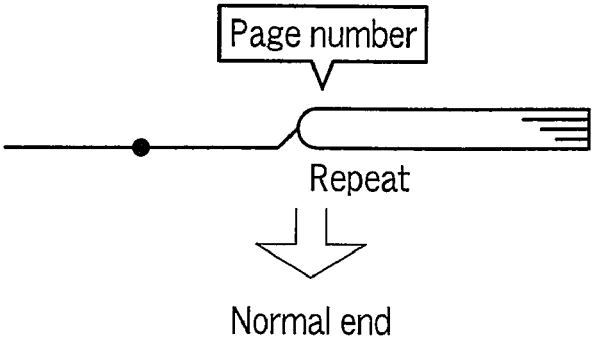
FIG. 46B

Input with topside down and upside down

BOOKLET PAGE TURNING APPARATUS

CROSS-REFERENCE TO RELATED APPLICATIONS

This application is based upon and claims the benefit of priority from prior Japanese Patent Applications No. 2008-115890, filed Apr. 25, 2008; and No. 2009-098276, filed Apr. 14, 2009 the entire contents both of which are incorporated herein by reference.

BACKGROUND OF THE INVENTION

1. Field of the Invention

The present invention relates to a booklet page turning apparatus, which is mounted in a booklet publishing machine and automatically turns the pages of a booklet.

2. Description of the Related Art

A recent booklet has a page with high bending rigidity as part of tendency to heighten the added value. For example, there is a booklet having an ID page given a security protective layer to prevent forgery countermeasures of personal information, or a plastic sheet page having a buried IC chip for high-density recording. Another booklet has a radio IC chip readable and writable without contact. A front or back cover of such a booklet is given a radio shielding function to protect recorded information from unauthorized reading or writing. Such a booklet accepts reading or writing only when a front cover is opened.

An ordinary booklet page turning apparatus causes buckling distortion in a booklet, assuming the low bending rigidity of a booklet, turns up a page with a page turning roller, and flips up the page on the page turning roller.

However, when an ordinary page turning apparatus attempts to turn a rigid page of a booklet, the difference between the frictional force between the page turning roller and the uppermost page and the friction force between the uppermost page and the page under the uppermost page does not meet the condition to cause buckling distortion in the rigid page.

If the page turning roller is changed to the one with higher frictional coefficient, it can cause buckling distortion in a booklet. However, in this case, a rigid page may suffer plastic deformation exceeding over its plastic deformation range, or a buried IC chip may suffer stress destruction. Therefore, in the prior art, a page turning roller contacts the end of a booklet, and is raised while rotating, thereby a rigid page is turned without buckling distortion (e.g., Jpn. Pat. Appln. KOKAI Publication No. 2005-144756).

However, in this method, the end of a rigid page must be accurately detected and made to contact the page turning roller, otherwise the page cannot be turned up.

Besides, pages of a booklet are fixed at the bound edge of a booklet like a cantilever structure, and tend to bend and become uneven at the ends after being repeatedly turned up and down, increasing the unstable elements of the page turning operation.

In a booklet having a rigid page mixed with ordinary body pages, after the rigid page and body pages are repeatedly turned up and down, the bending and unevenness of the ends of the pages are accelerated, and the unstable elements of the page turning operation are increased.

As described above, a booklet having two or more rigid pages is difficult to stably turn the pages by using page turning rollers.

As a method of separating a sheet one by one from a stack and conveying each sheet, a negative suction method using a vacuum pad is well known.

This method does not depend on the rigidity of a medium, and is advantageous to a booklet including two or more rigid pages.

A vacuum pad is available in various types according to the properties of a medium. One type of vacuum pad has an axle of rotation for oscillation. Another type of vacuum pad is deformable (made of rubber material or shaped like bellows).

However, if such a negative suction method is simply applied to a booklet page turning apparatus, the pages of a booklet cannot be turned unless each page of a booklet is raised by turning up over 90° with respect to the bound edge of a booklet, and a travel of a vacuum pad is increased. This makes it difficult to house the vacuum pad structure in the same conveying layout as in the conventional page turning apparatus using buckling distortion.

BRIEF SUMMARY OF THE INVENTION

Embodiments of the present invention have been made in the above circumstances. It is an object of the invention to provide a booklet page turning apparatus configured to turn pages of a booklet without increasing a travel of a vacuum pad.

According to an aspect of the invention, there is provided a page turning apparatus comprising a conveying device to covey a booklet to a page turning position; a vacuum pad to vacuum suck the uppermost page of the booklet conveyed to a page turning position by the conveying device; a driving device to move the vacuum pad to pick up the uppermost page of the booklet at a predetermined angle in the opening direction around a bound edge; a contact roller to go under the uppermost page raised at a predetermined angle; and a control device which releases the vacuum suction of the vacuum pad, and moves the vacuum pad in the direction of retreating from the uppermost page after the contact roller goes under the uppermost page, and conveys the booklet so that the uppermost page is brought into contact with the contact roller, and opened.

According to another aspect of the invention, there is provided a page turning apparatus comprising a conveying device to covey a booklet to a page turning position; a vacuum pad to vacuum suck the uppermost page of the booklet conveyed to a page turning position by the conveying device; a driving device to move the vacuum pad to pick up the uppermost page of the booklet at a predetermined angle in the opening direction around a bound edge; a first contact roller to go under the uppermost page raised at a predetermined angle, and a second contact roller provided in the upstream of the booklet conveying direction of the first contact roller; and a control device which releases the vacuum suction of the vacuum pad, and moves the vacuum pad in the direction of retreating from the uppermost page after the first contact roller goes under the uppermost page, and conveys the booklet so that the uppermost page is brought into contact with the first contact roller, and opened, wherein the control device conveys the booklet in the reverse direction to locate the uppermost page at a page turning position, after the uppermost page of the booklet is opened, controls the vacuum pad to suck the uppermost page conveyed to the page turning position, moves the vacuum pad to turn and pick up the uppermost page at a predetermined angle in the opening direction around a bound edge, causes the second contact roller to go under the uppermost page picked up at a predetermined angle, releases the vacuum suction of the vacuum pad and moves the vacuum pad in the direction of retreating from the uppermost page, after the second contact roller goes under the uppermost page, and conveys the booklet in the reverse direction so that the uppermost page is brought into contact with the contact roller, and opened.

According to a still another aspect of the invention, there is provided a page turning apparatus comprising a conveying device to covey a booklet to a page turning position; a vacuum pad to vacuum suck the uppermost page of the booklet conveyed to a page turning position by the conveying device; a driving device to move the vacuum pad to pick up the uppermost page of the booklet at a predetermined angle in the opening direction around a bound edge; a first contact roller to go under the uppermost page raised at a predetermined angle; a second contact roller provided in the upstream of the booklet conveying direction of the first contact roller; and a control device which releases the vacuum suction of the vacuum pad, and moves the vacuum pad in the direction of separating from the uppermost page after the first contact roller goes under the uppermost page, and conveys the booklet so that the uppermost page is brought into contact with the first contact roller, and opened; and a detection device to detect the page number of the opened uppermost page, wherein when the page number detected by the detection device is different from the page number of the uppermost page, the control device repeats the opening operation, and when the uppermost page of the booklet is correctly opened, the control device conveys the booklet in the reverse direction to locate the uppermost page at a page turning position, controls the vacuum pad to suck the uppermost page conveyed to the page turning position, moves the vacuum pad to turn and pick up the uppermost page at a predetermined angle in the opening direction around a bound edge, causes the second contact roller to go under the uppermost page picked up at a predetermined angle, releases the vacuum suction of the vacuum pad and moves the vacuum pad in the direction of retreating from the uppermost page, after the second contact roller goes under the uppermost page, and conveys the booklet in the reverse direction so that the uppermost page is brought into contact with the contact roller, and opened.

According to other aspects of the invention, booklet pages can be turned without increasing a travel of a vacuum pad.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

FIG. 45A is a diagram showing the page turning operation;

FIG. 45B is a diagram showing the page turning operation;

FIG. 46A is a diagram showing the operation of turning pages of the book;

FIG. 46B is a diagram showing the operation of turning pages of the book;

DETAILED DESCRIPTION OF THE INVENTION

Hereinafter, embodiments of the invention will be explained in detail with reference to the accompanying drawings.

Figure 1:
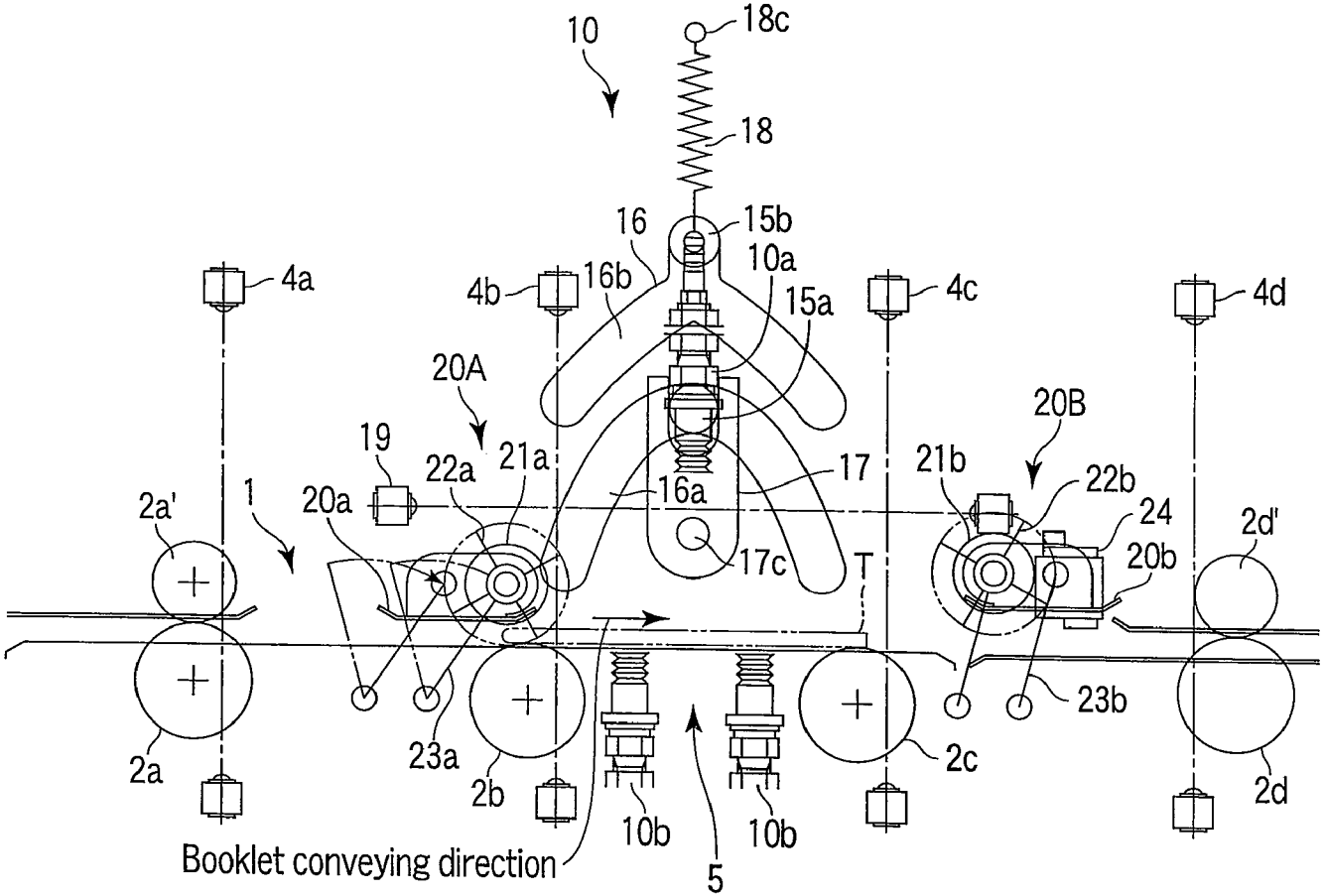
FIG. 1 is a diagram showing a configuration of a booklet page turning apparatus according to a first embodiment of the invention.

FIG. 1 is a schematic diagram showing a configuration of a booklet page turning apparatus according to a first embodiment of the invention.

In the drawing, a reference number 1 denotes a conveying path to convey a booklet T. The conveying path 1 has conveying rollers 2*a* to 2*d* as a conveying device, and detection sensors 4*a* to 4*d* to optically detect a booklet T, which are arranged at predetermined intervals along a booklet T conveying direction. Pinch-rollers 2*a*' and 2*d*' are provided on the conveying rollers 2*a* and 2*d* in a contacting fashion. The conveying rollers 2*b* and 2*c* are placed at a page turning position 5. The conveying rollers 2*a* to 2*d* are rotationally driven with a conveying roller drive motor 26 shown in FIG. 5.

Figure 5:
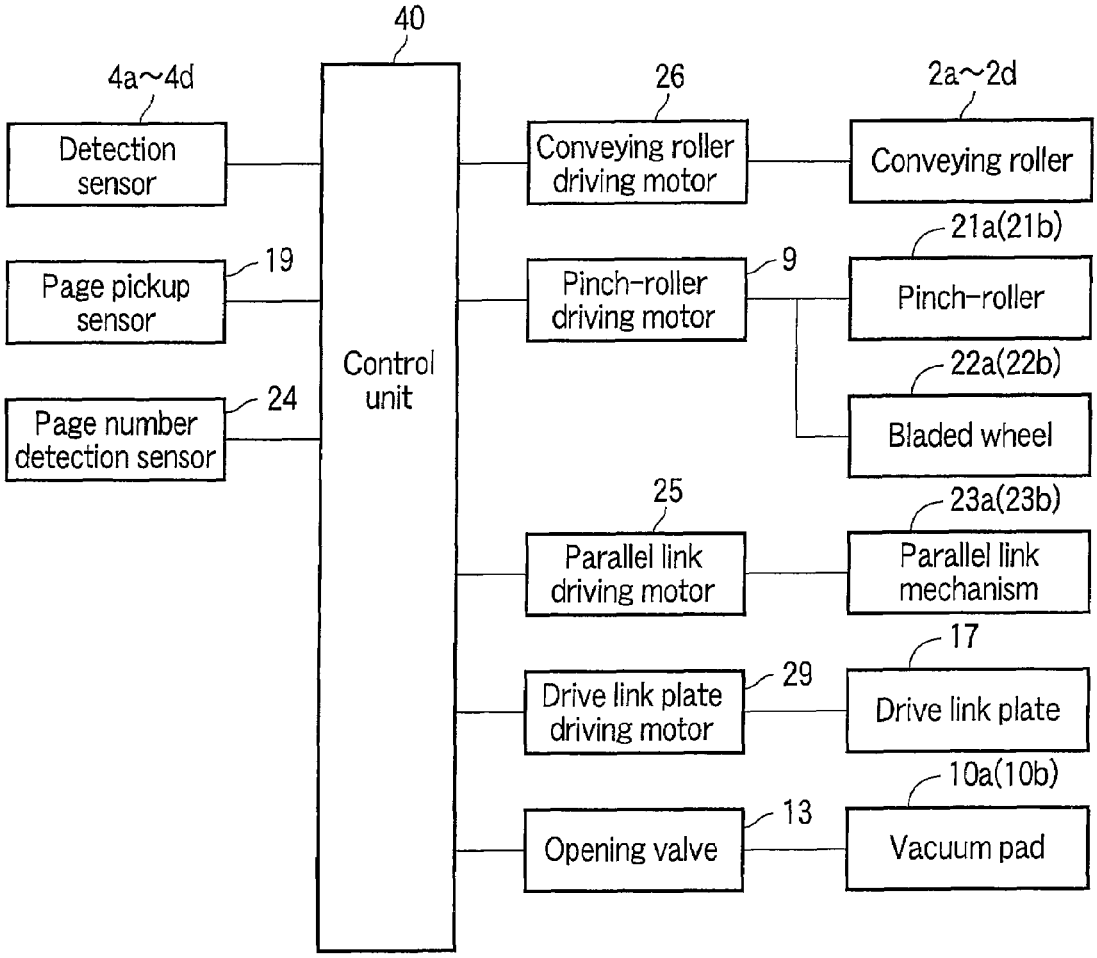
FIG. 5 is a block diagram of a drive control system of the page turning apparatus of FIG. 1.

Contact feed mechanisms 20A and 20B are provided above the conveying rollers 2*b* and 2*c*. A page pickup detection sensor 19, which optically detects a page sucked and picked up by a vacuum pad 10*a* described later, is provided above the page turning position 5. A page number detection sensor 24 as a detection device to detect the page number of a turned page is provided close to the contact feed mechanism 20B. The detection sensors 4*a* to 4*d*, page pickup detection sensor 19, and page number detection sensor 24 are connected to a control unit 40 through a signal circuit as a control device as shown in FIG. 5.

Figure 2:
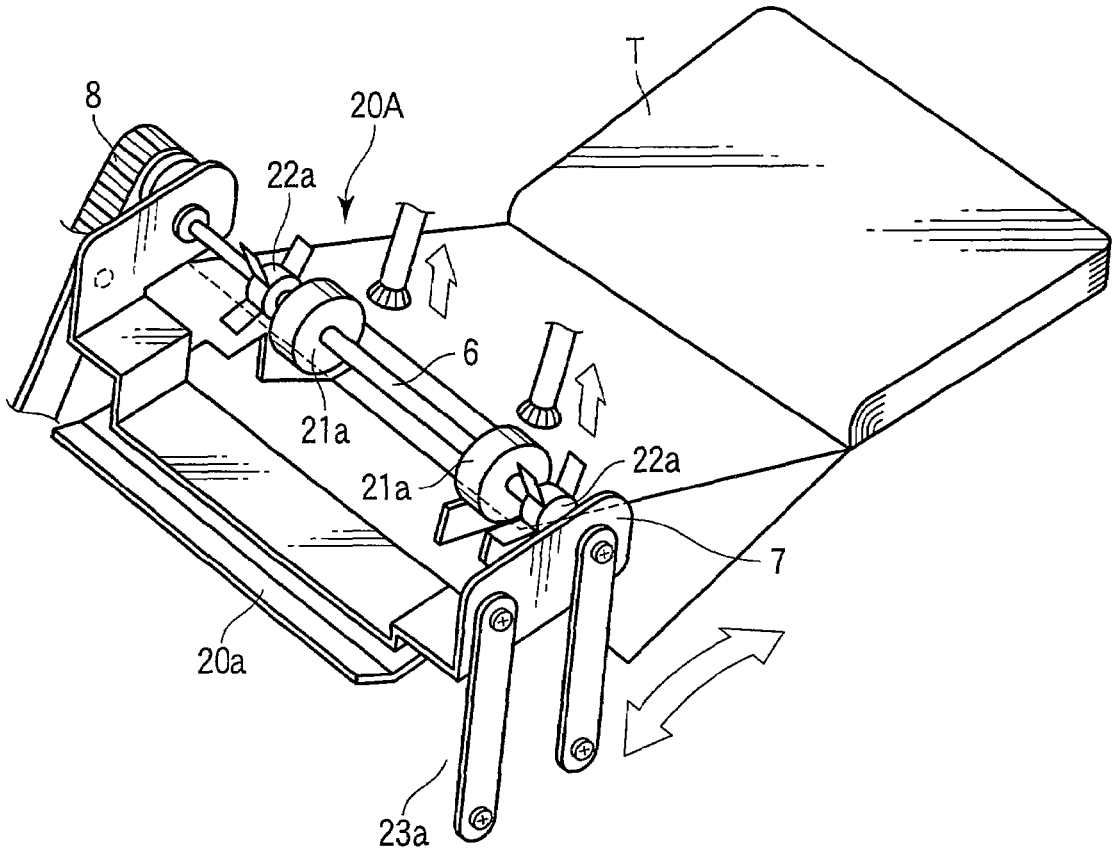
FIG. 2 is a perspective view showing a pinch-roller, a bladed wheel, and their drive system of the page turning apparatus of FIG. 1.

The contact feed mechanism 20A is provided with a pinch-roller 21*a* as a second contact roller. The pinch-roller 21*a* is fixed to a shaft 6 as shown in FIG. 2. A bladed wheel 22*a* is provided close to the pinch-roller 21*a* on the shaft 6. The bladed wheel 22*a* has flexible tapping blades on the periphery, which contact the booklet T and tap down the lower part of the page to be turned over, when the wheel rotates.

FIG. 2 shows a drive system of the pinch-roller 21*a* and bladed wheel 22*a*.

The shaft 6 is rotatably supported by a support bracket 7. On end of the shaft 6 is projected outward the bracket 7. The projected end of the shaft 6 is connected to a pinch-roller drive motor 9 (shown in FIG. 5) through a drive belt 8, so that the pinch-roller 21*a* and bladed wheel 22*a* are rotated forward and rearward by the pinch-roller drive motor 9.

The support bracket 7 is provided with a guide body 20*a* as a unit to guide conveyance of the booklet T. The support bracket 7 is supported by a parallel link mechanism 23*a*. The parallel link mechanism 23*a* is rotated forward and rearward by a parallel link drive motor 25 (shown in FIG. 5). When the parallel link mechanism 23*a* is rotated, the guide body 20*a* is moved together with the pinch-roller 21*a* and bladed wheel 22*a*, between a conveying position close to the conveying roller 2*b* and a standby position upper left of the conveying position.

The contact feed mechanism 20B is configured similar to the contact feed mechanism 20A. Namely, the contact feed mechanism 20B is provided with a guide body 20*b*, a pinch-roller (a first contact roller) 21*b*, a bladed wheel 22*b*, and a parallel link mechanism 23*b*, so that the guide body 20*b*, pinch-roller 21*b* and bladed wheel 22*b* are moved between a conveying position close to the conveying roller 2*c* and a standby position upper right of the conveying position.

A page turning-sucking mechanism 10 is provided at the page turning position 5.

Figure 3:
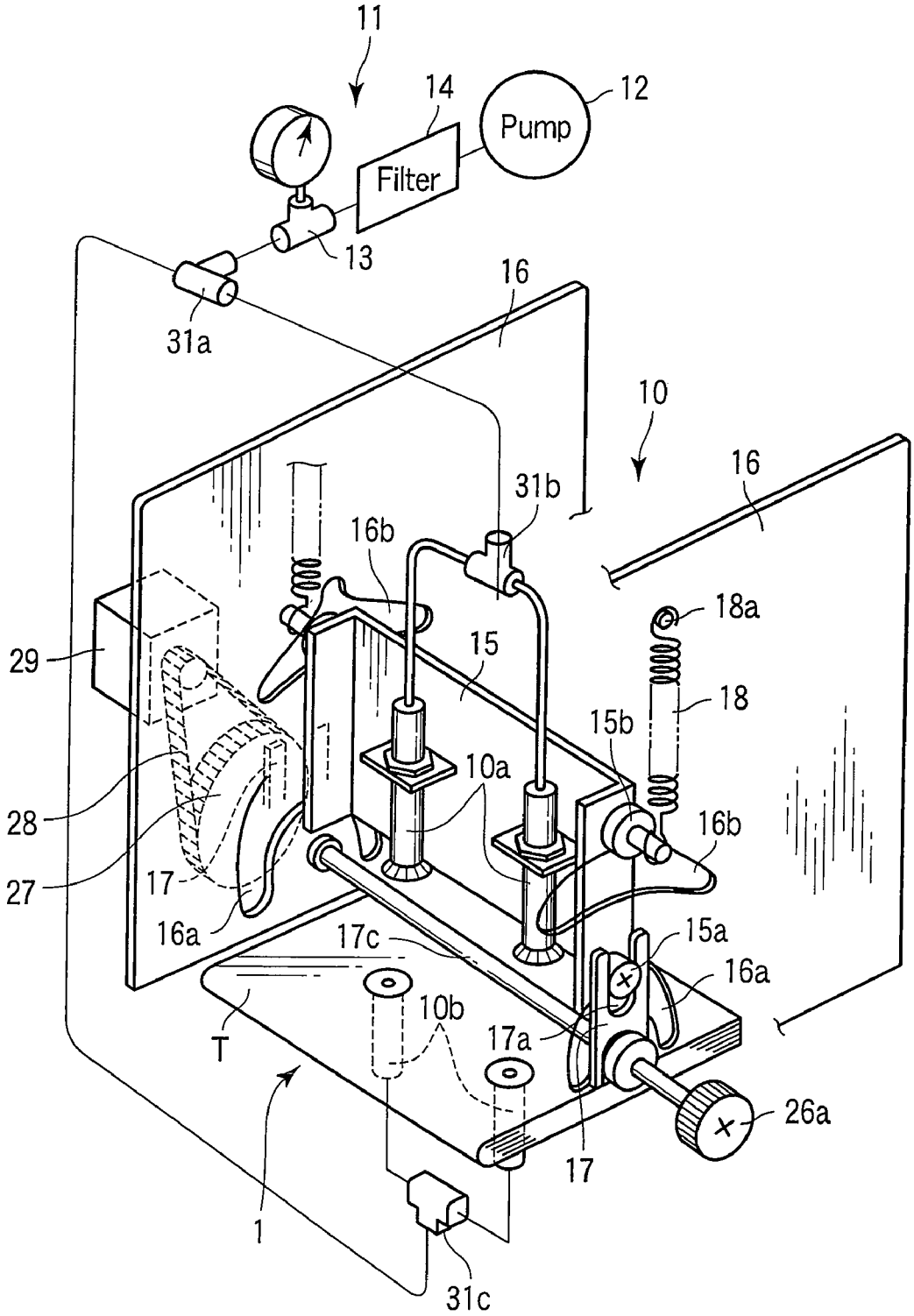
FIG. 3 is a perspective view showing a vacuum pad and its drive system of the page turning apparatus of FIG. 1.

Hereinafter, the turning-sucking mechanism 10 will be explained with reference to FIG. 3.

The turning-sucking mechanism 10 has vacuum pads 10*a* and 10*b* on the upper side and lower side of the conveying path 1. The lower-side vacuum pad 10*b* is provided with a suction port faced up, and opposes the lower side of the booklet T conveyed right above. The upper-side vacuum pad 10*a* is fixed to a support rack 15. The vacuum pads 10*a* and 10*b* are connected to a pump 12 through a negative pressure supply circuit 11. The negative pressure supply circuit 11 includes a filter 14 to separate dust in the air sucked in by the negative pressure, an operation value 13 to switch the negative pressure, and branch tubes 31*a* to 31*c*.

When the operation valve 13 is opened, negative pressure is generated in the vacuum pads 10*a* and 10*b*, and the booklet T is opposed to and sucked by the vacuum pads 10*a* and 10*b*. The sucking force W of the vacuum pads 10*a* and 10*b* is obtained by the following equation.

$$W=0.1\times P\times A/S$$

P: Vacuum pressure (gauge pressure) [−kPa]

A: Vacuum pad area [$cm^2$]

S: Safety ratio

Guide rings 15*a* and 15*b* are provided in the upper and lower parts of the side of the support rack. Guide plates 16 are provided along the longitudinal direction of the support track 15. The guide rings 15*a* and 15*b* of the support track 15 are fit in cam grooves 16*a* and 16*b* of the guide plates 16.

The lower guide ring 15*a* is also fit in a groove 17*a* of a drive link plate 17 as a drive device. The drive link plate 17 is connected to a drive shaft 17*c*. The drive shaft 17*c* is extended and held between the guide plates 16. A hand knob 26*a* is fixed to one end of the drive shaft 17*c*, and a drive link plate drive motor 29 is connected to the other end through a drive pulley 27 and a drive belt 28.

The axis of the upper guide ring 15*b* is connected to a hook 18*a* through a spring 18, and the support rack is elastically energized in the upper direction. When the drive link plate drive motor 29 is driven, the drive shaft 17*c* is rotated through the drive belt 28 and drive pulley 27, and the drive link plate 17 is rotationally moved forward and rearward (to the right and left). By this rotational movement, the guide rings 15*a* and 15*b* are guided along the cam grooves 16*a* and 16*b* of the guide plate 16, and moves the support rack 15.

The drive link plate 17 points in the direction of twelve o'clock direction in the initial sate before the support rack is moved, and the vacuum pad 10*a* supported by the support rack 15 waits ready at the upper standby position.

Figure 4:
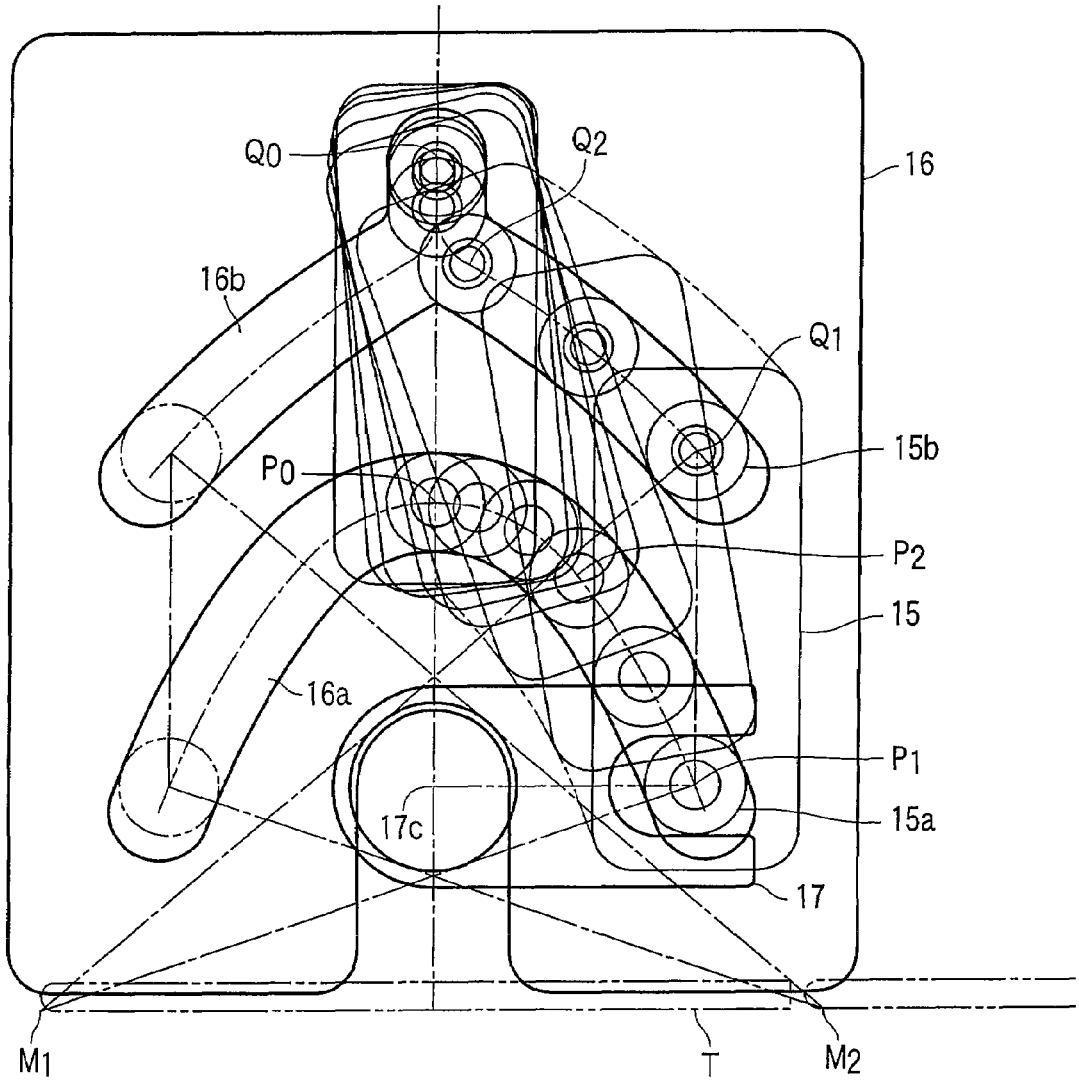
FIG. 4 is a diagram showing the moving path of the vacuum pad of FIG. 3.

FIG. 4 shows the tracks of the vacuum pads of the support rack 15 moving along the booklet T page turning position 5 and the cam grooves 16*a* and 16*b* of the guide plate 16. A reference number M1 denotes the bound edge of the booklet T at the page turning start position, and M2 denotes the bound edge of the booklet T at the reverse page turning start position. A reference symbol Pn denotes the center position of the guide ring 15*a*, and Qn denotes the center position of the guide ring 15*b*.

The position and direction of the support rack 15 are determined at the center positions Pn and Qn of the guide rings 15*a* and 15*b*. The vacuum pad 10*a* is moved together with the support rack 15. Namely, P1 to P2 and Q1 to Q2 in the cam grooves 16*a* and 16*b* of the guide plate 16 are arc-shaped around M1. During the arc-shaped movement, the vacuum pad 10*a* is moved around M1 in synchronization with the pickup motion around the bound edge of the uppermost page of the booklet T.

In the reverse page turning, the motion of the vacuum pad 10*a* and the shape of the cam grooves 16*a* and 16*b* of the guide plate 16 are symmetrical around M2.

P0 to P2 is shaped like an arc smoothly connecting the curves of the symmetrical development of P1 to P2, and Q0 to Q2 is shaped like linearly moving back in the object axis direction of the cam groove 16*b* of the guide plate 16.

Therefore, the inclination of the support track 15 is decreased, and returned to vertical, at the standby position (initial position) above the vacuum pad 10*a*.

The drive link plate 17 to move the guide ring 15*a* around the drive shaft (rotation center) 17*c* points the twelve o'clock direction at this time, and can move the support rack 15 symmetrically in either clockwise or counterclockwise direction. Thereby, the maximum retreat position of the vacuum pad 10*a* in the page turning operation coincides with the rearward page turning start position, and forward and rearward page turning are possible in a compact range.

The positions of M1 and M2 may be displaced from the actual booklet T bound edge, depending on the thickness and binding method of the booklet T, the positions of rigid pages, or variations in the page turning start position caused by the manner of conveying. In the operation of picking up the uppermost page of the booklet T, the vacuum pad 10*a* may not move in an ideal path and may be displaced. However, if the pickup angle is smaller than 45°, there is a play for balancing between the booklet T and the vacuum pads 10*a* and 10*b*, and the displacement is not a problem. The play is caused by the elastic deformation of the vacuum pad 10 and elastic deformation in the vicinity of the bound edge of the booklet T.

FIG. 5 is a block diagram of a drive control system of the above-described page turning apparatus.

As described above, the detection sensors 4*a* to 4*d*, page pickup detection sensor 19, and page number detection sensor 24 are connected to the control unit 40 as a control device through a signal circuit. The control unit 40 is connected to the operation valve 13, and the drive motors 9, 25, 26 and 29 for the pinch-roller, parallel link, conveying roller, and drive link plate, respectively, so that the driving of the pinch-rollers 21*a* and 21*b*, bladed wheels 22*a* and 22*b*, parallel link mechanisms 23*a* and 23*b*, conveying rollers 2*a* to 2*d*, drive link plate 17, and vacuum pads 10*a* and 10*b* is controlled based on a detection signal.

Figure 6:
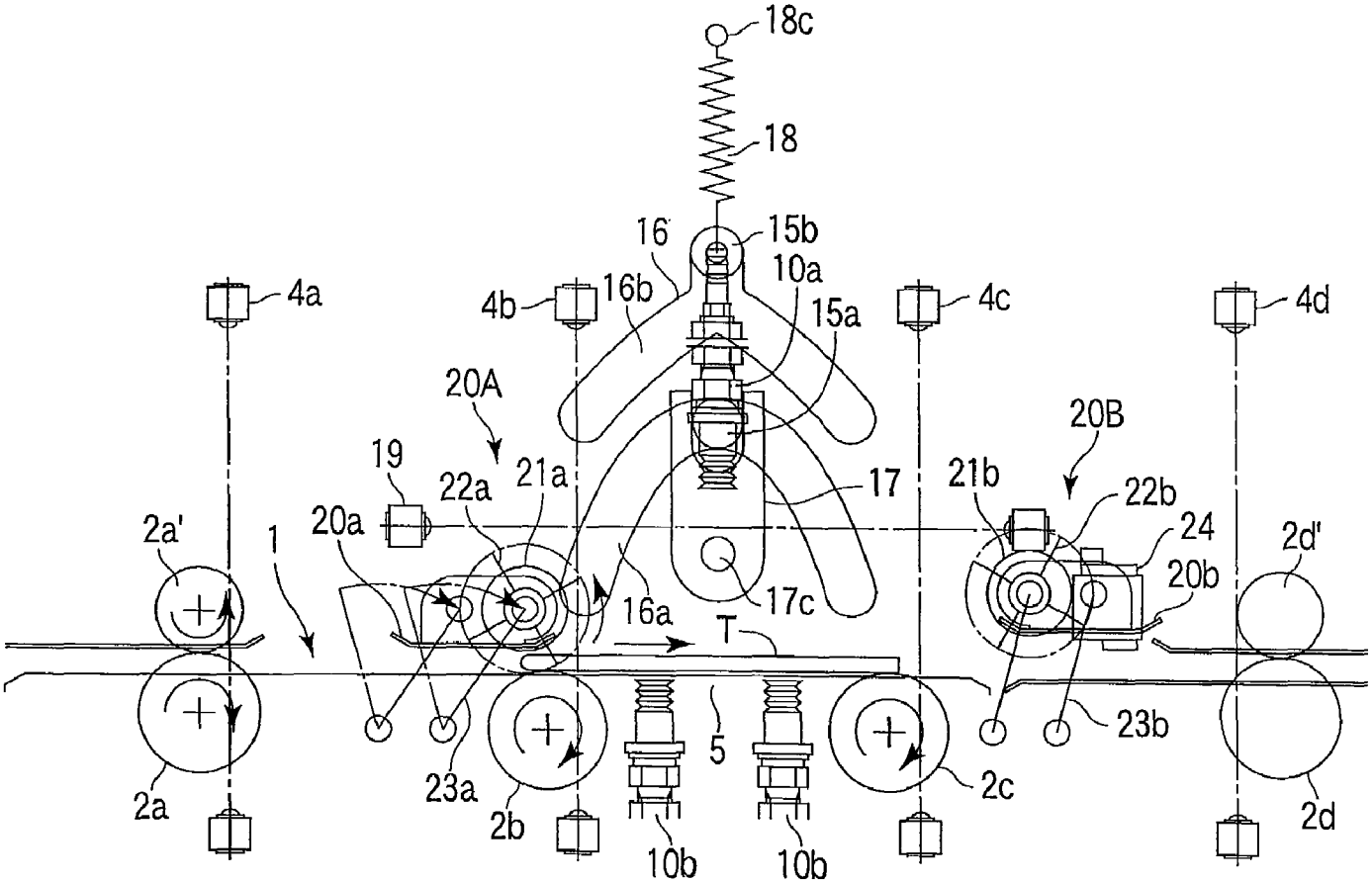
FIG. 6 is a diagram showing the state in which a booklet is conveyed to a page turning position of the page turning apparatus of FIG. 1.
Figure 7:
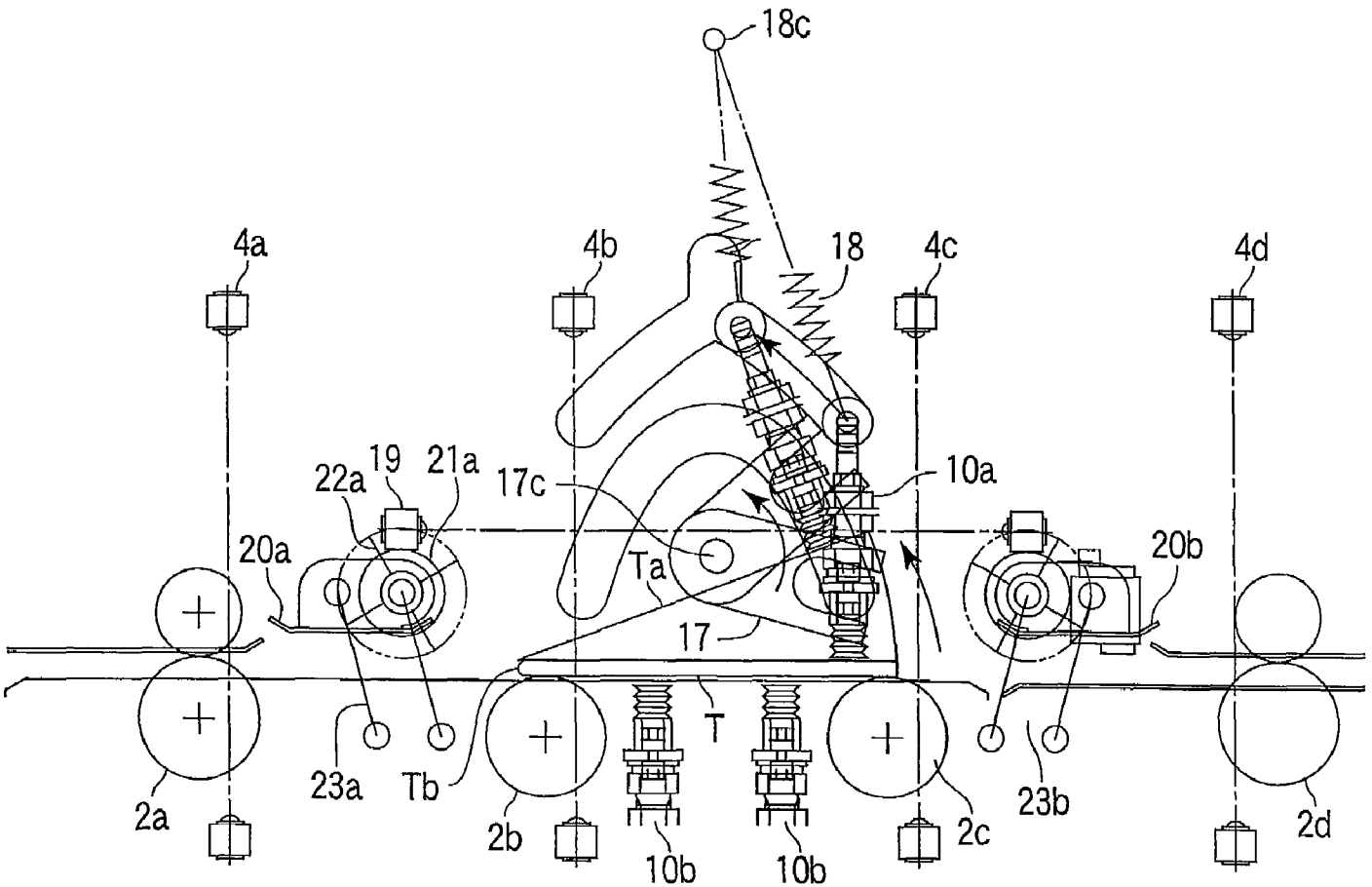
FIG. 7 is a diagram showing the state in which the uppermost page of the booklet conveyed to the page turning position of FIG. 6 is picked up by a vacuum pad.

Next, an explanation will be given of the operation of turning the pages of the booklet T with reference to FIGS. 6 to 15. The booklet T is conveyed rightward along the conveying path 1 by the rotation of the conveying roller 2*a* in the direction of arrow. When the booklet T is conveyed to the detection sensor 4*b* and detected there, the control unit 40 rotates the pinch-roller 21*a* and bladed wheel 22*a* in the direction of arrow, and operates a parallel link mechanism 33*a*. By the operation of the parallel link mechanism 23*a*, as shown in FIG. 6, a movable guide 20*a* is moved from the standby position to the conveying position together with the pinch-roller 21*a* and bladed wheel 22*a*, and the booklet T is held and conveyed farther to the right by the conveying roller 2*b* and pinch-roller 21*a*. When the booklet T is conveyed in this way and detected by the detection sensor 4*c*, the conveying roller 2*b* and pinch-roller 21*a* are rotated in the reverse direction by the predetermined number of pulses, and the booklet T is fed in the reverse direction and stopped at the predetermined page turning start position 5. Then, as shown in FIG. 7, the parallel link mechanism 23*a* is moved in the direction reverse to the booklet T conveying direction, and the movable guide 20*a* is moved from the conveying position to the standby position, together with the pinch-roller 21*a* and bladed wheel 22*a*.

At this time, the operation value 13 is operated, negative pressure is generated in the vacuum pads 10*a* and 10*b*, and the lower side of the booklet T is sucked and held by the lower vacuum pad 10*b*. Further, the drive link plate drive motor 29 is operated, and as shown in FIG. 7, the drive link plate 17 is rotated clockwise, and the upper-side vacuum pad 10*a* contacts and sucks the uppermost plate Ta of the booklet T. Then, the drive link plate 17 is rotated in the reverse direction (counterclockwise), and is moved upward along the path of the cam groove 16*a* of the guide plate 16, while the vacuum pad 10*a* is sucking the uppermost page Ta. Thereby, the uppermost page Ta of the booklet T is pickup up just like pivoting about the bound edge Tb while being sucked by the vacuum pad 10*a*. The uppermost page Ta is simply rotationally moved about the bound edge Tb, and is given no bending deforming force, and the page rigidity is not influenced by the page turning operation.

Figure 8:
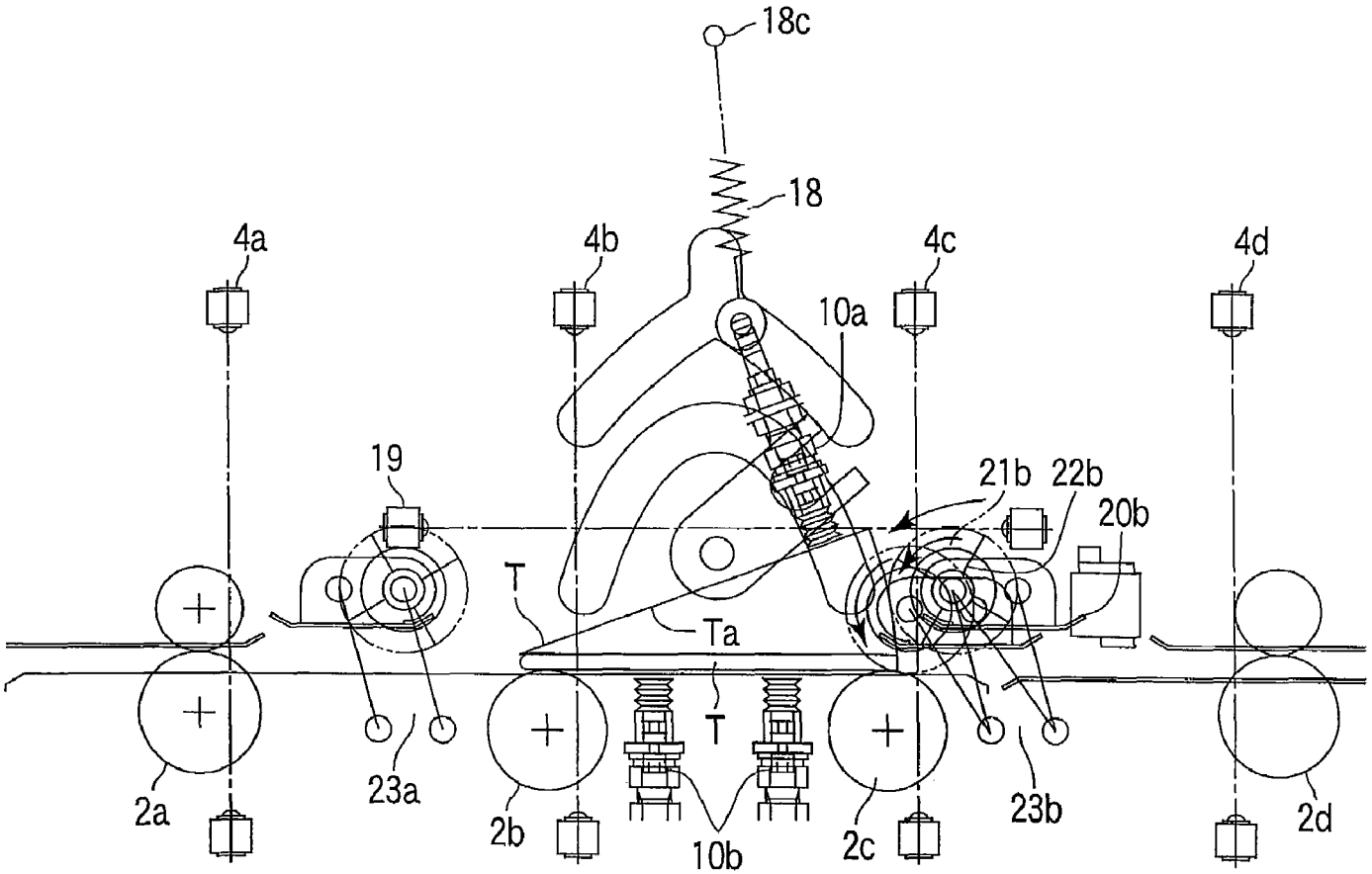
FIG. 8 is a diagram showing the state in which a pinch-roller goes under the uppermost page picked up by the vacuum pad in FIG. 7.

When the uppermost page Ta of the booklet T is picked up to the predetermined position, it is detected by the page pickup detection sensor 19. Based on the detection, the control unit 40 is operated, and the movable guide 20*b* is moved from the standby position to the conveying position together with the rotating pinch-roller 21*b* and bladed wheel 22*b*, as shown in FIG. 8. At this time, the lower pages floated by the picked-up uppermost page Ta of the booklet T are tapped down by the tapping blades of the bladed wheel 22*b*, and the pinch-roller 21*b* goes into the page immediately under the uppermost page Ta.

Figure 9:
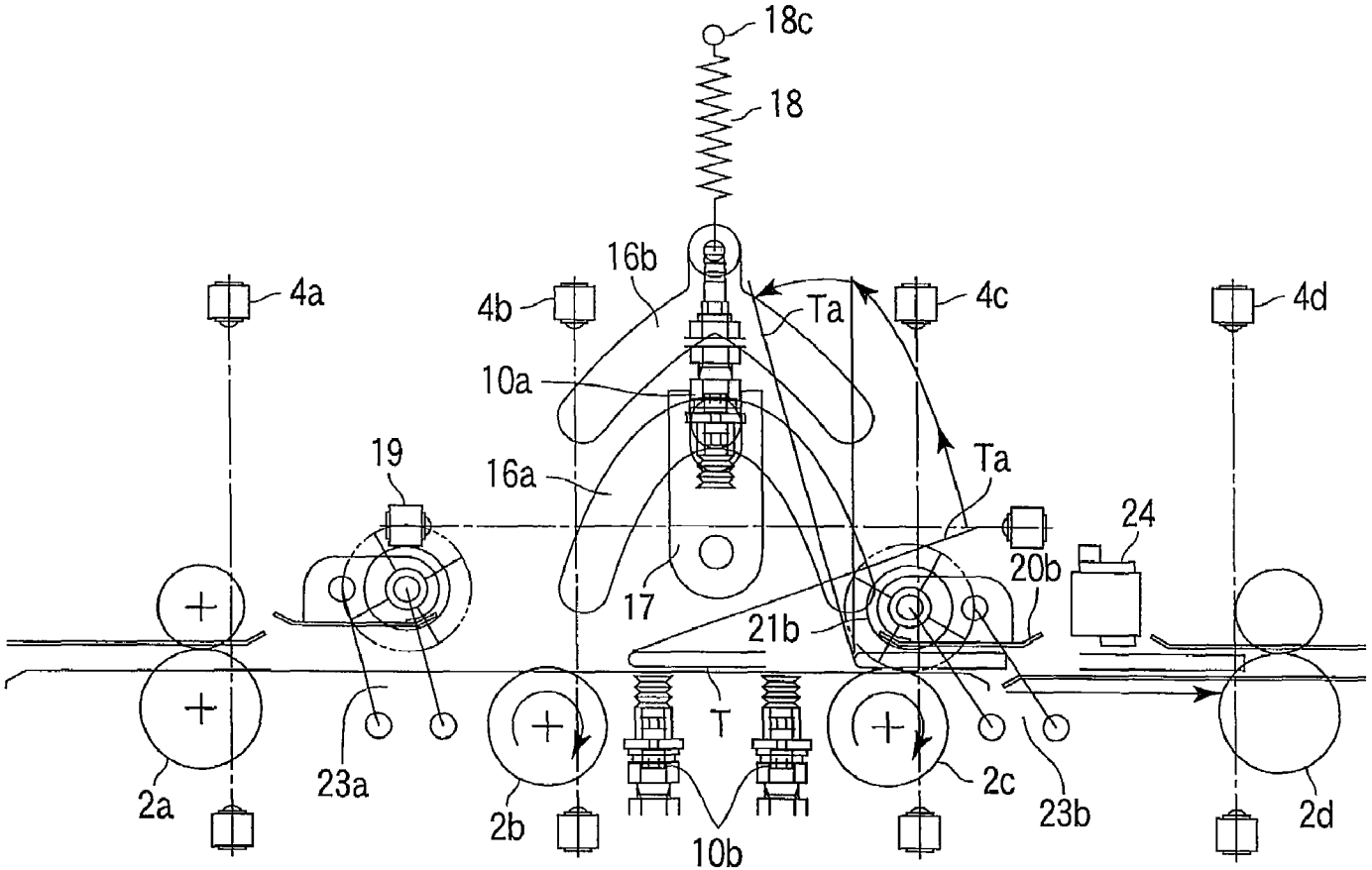
FIG. 9 is a diagram showing the state in which a booklet is conveyed with the pinch-roller gone under the uppermost page in FIG. 8.

Thereafter, the operation valve 13 is closed by the control unit 40, and suction of the vacuum pad 10*a* is stopped. Then, as shown in FIG. 9, the drive link plate 17 is returned to the direction of twelve o'clock, and the vacuum pad 10*a* is returned to the upper standby position. The booklet T is held and conveyed to the right by the rotation of the conveying roller 2*c* and pinch-roller 21*b*, detected by the booklet detection sensor 4*d*, and stopped. Thereby, the uppermost page Ta of the booklet T contact contacts the pinch-roller 21*b*.

Figure 10:
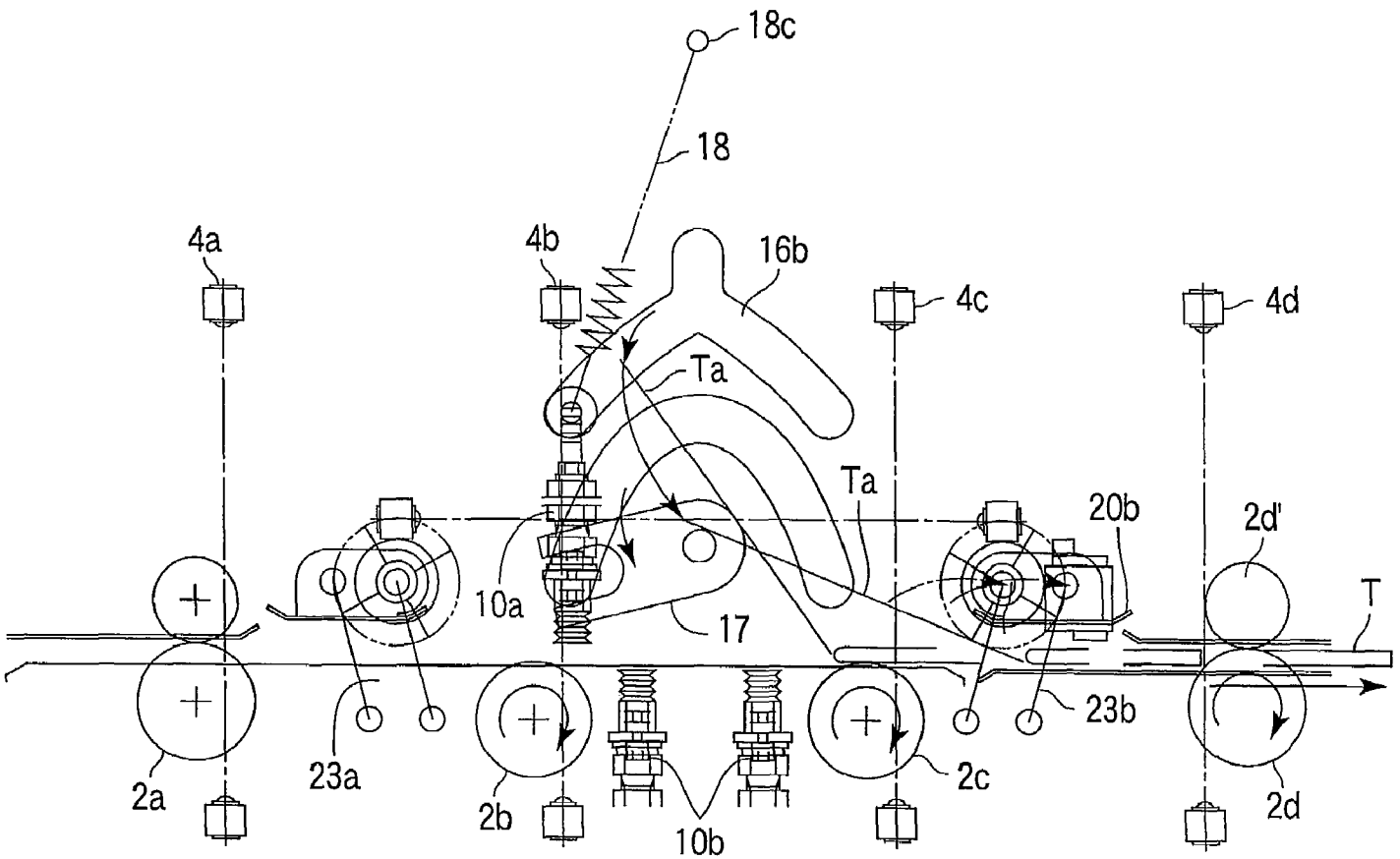
FIG. 10 is a diagram showing the state in which the uppermost page of the booklet conveyed in FIG. 9 is made to contact a pinch-roller and turned down.
Figure 11:
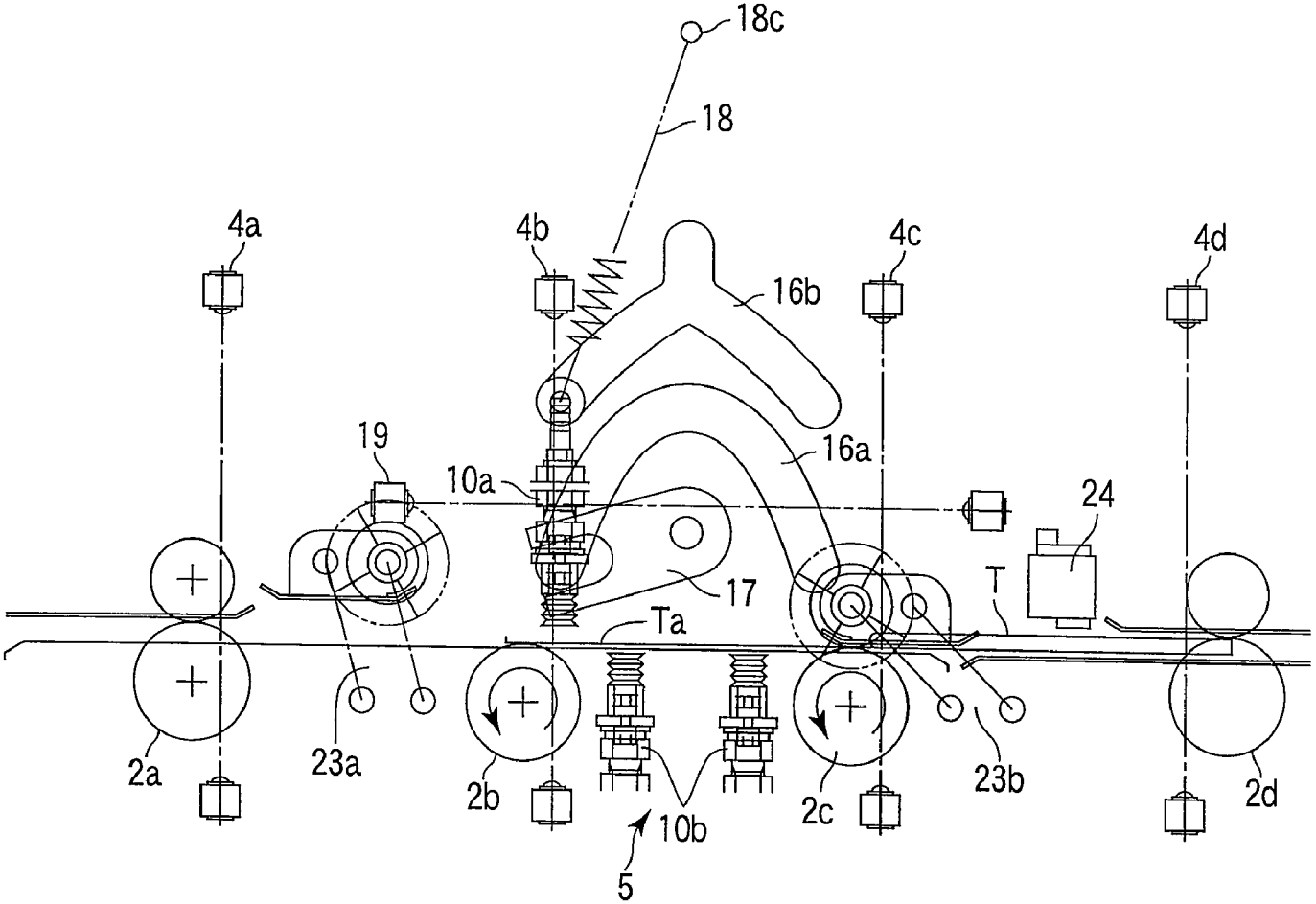
FIG. 11 is a diagram showing the state in which the uppermost page in FIG. 10 is completely turned down.

At this time, the drive link plate 17 rotates counterclockwise from the initial state, and moves the vacuum pad 10*a* so as to retreat from a turning-down range of the turned-up uppermost page Ta of the booklet T as shown in FIG. 10. At this time, the right end of the booklet T has been held ready to be conveyed by the conveying roller 2*d* and pinch-roller 2*d*', and the movable guide 20*b* is returned to the standby state. The conveying roller 2*d* is rotated in this state, and the turned-up uppermost page Ta of the booklet T is completely turned down in a state interrupted by no surrounding parts as shown in FIG. 11. Therefore, operation can be completed without depending on the rigidity of the page.

In the conveyance, the page number detection sensor 24 scans the page number recorded on an opened page Ta of the booklet T. The scanned information is sent to the control unit 40. Based on the scanned information, the control unit 40 determines whether the page turning operation is executed faithfully to a program. If the page turning operation is found not faithful to a program, the page turning operation is retried.

Figure 12:
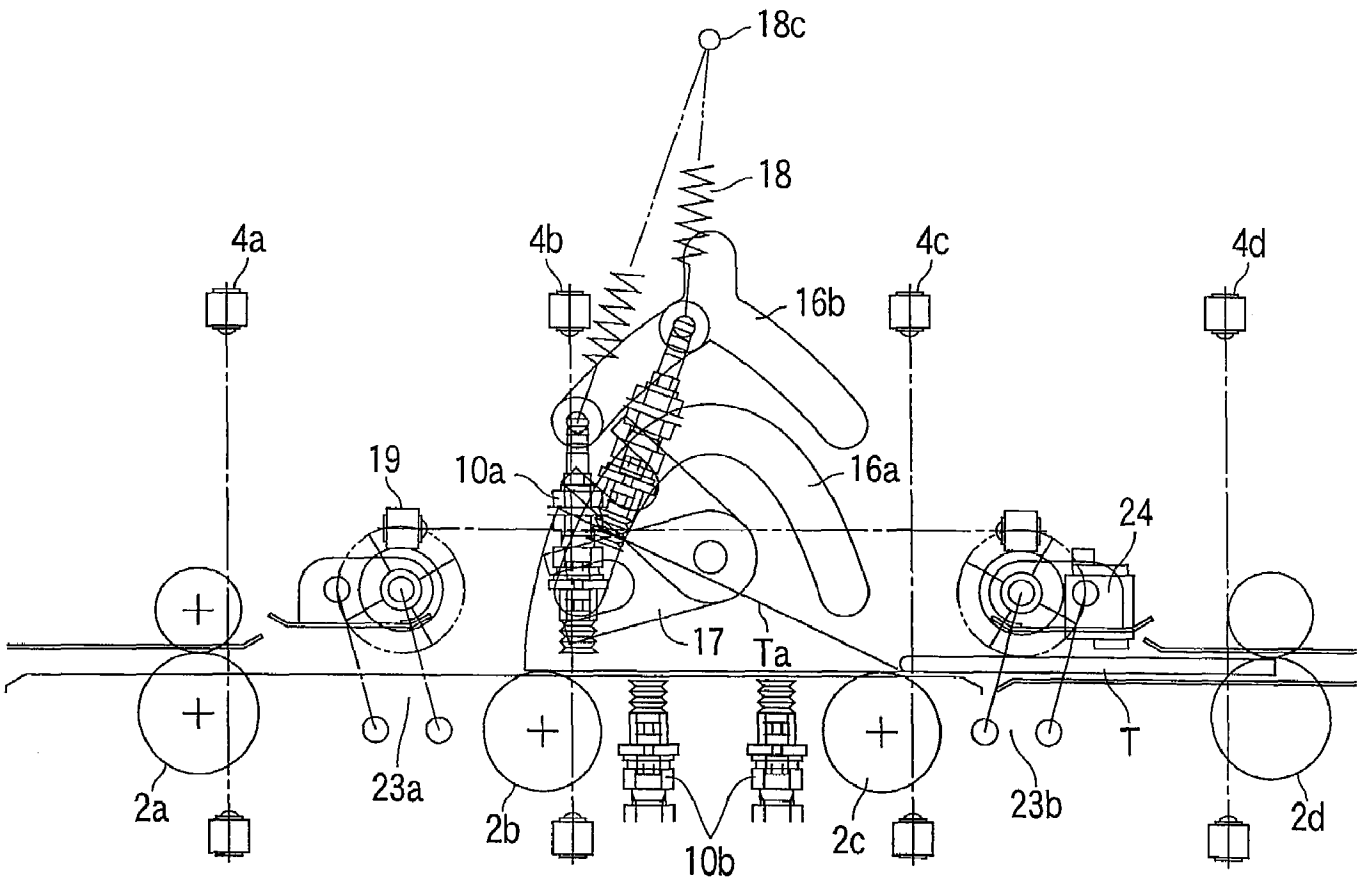
FIG. 12 is a diagram showing the state in which the uppermost page completely turned down in FIG. 11 is picked up in the reverse turning direction by a vacuum pad.
Figure 13:
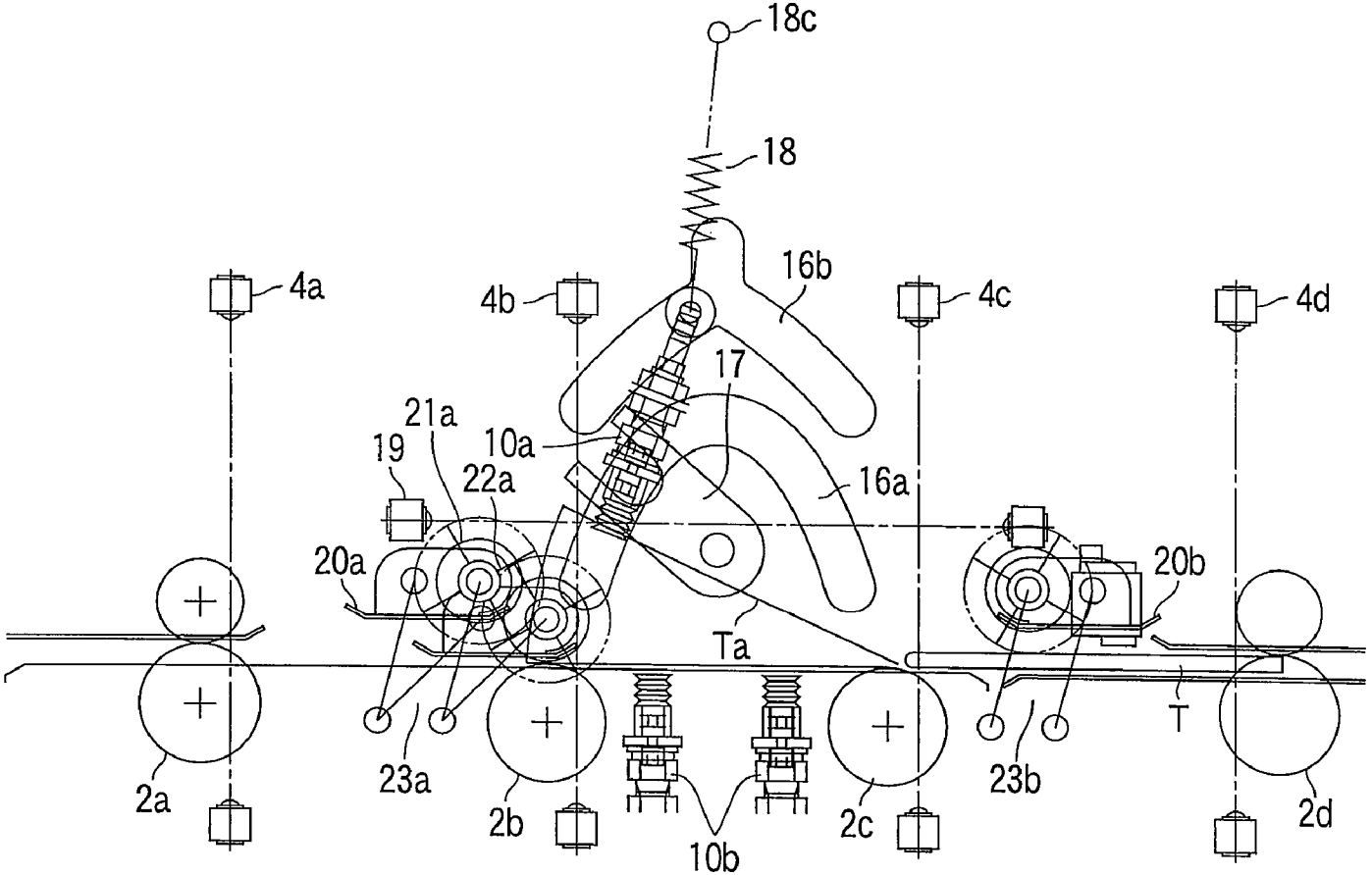
FIG. 13 is a diagram showing the state in which a pinch-roller goes under the uppermost page picked up in FIG. 12.
Figure 14:
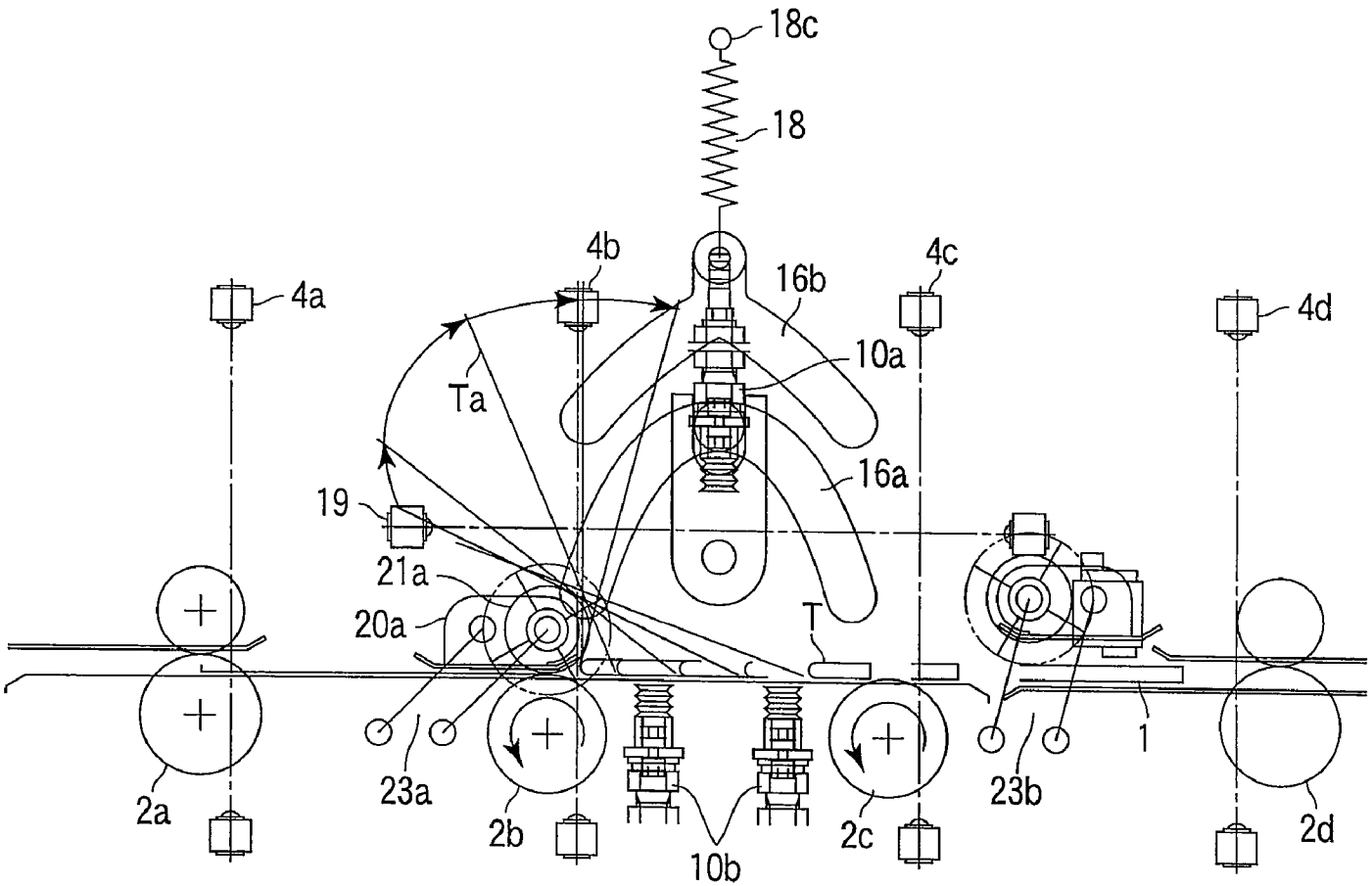
FIG. 14 is a diagram shown the state in which the uppermost page contacts the pinch-roller gone under the uppermost page in FIG. 13.
Figure 15:
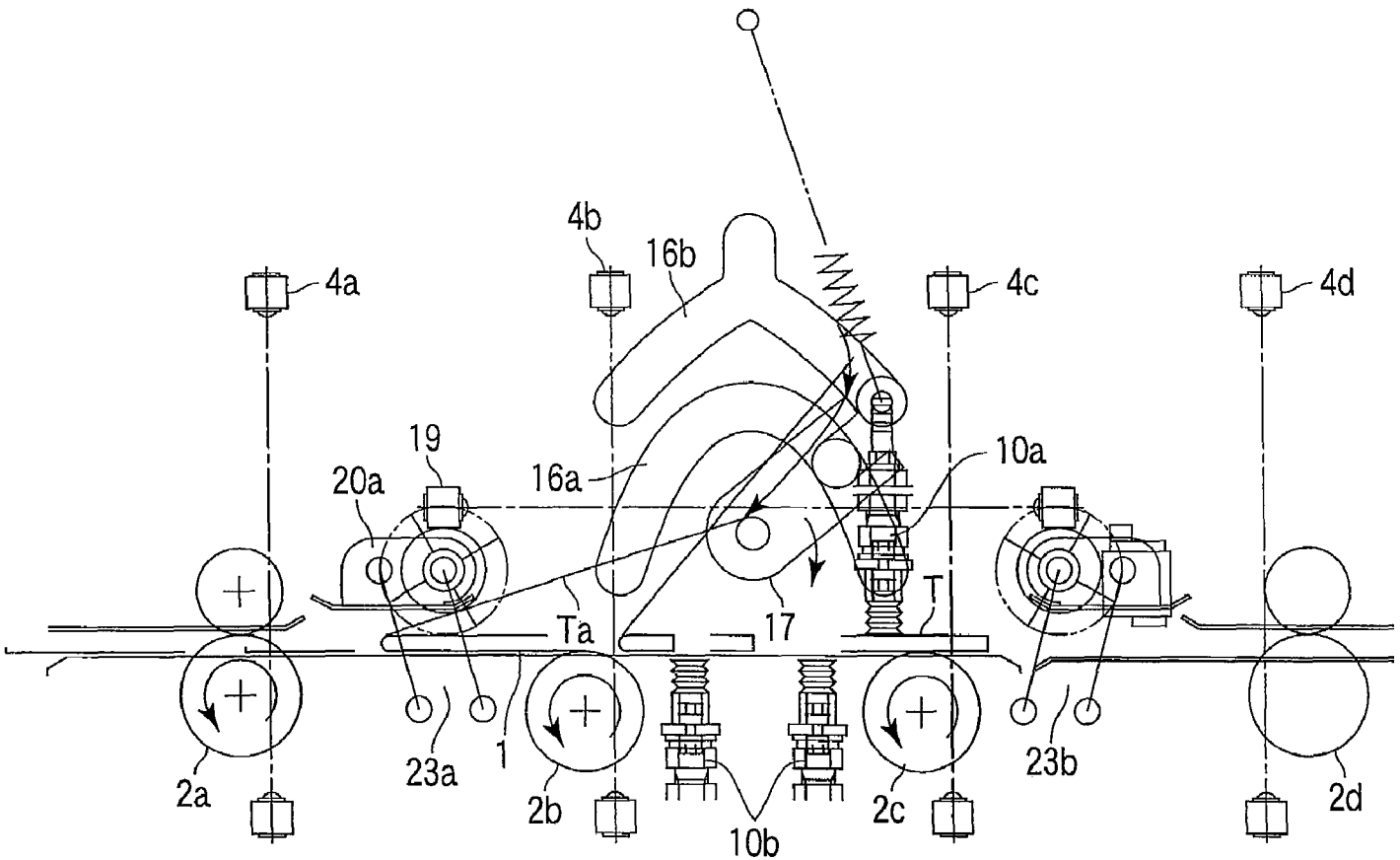
FIG. 15 is a diagram showing the state in which the uppermost page made to contact the pinch-roller in FIG. 14 is largely rotated in the reverse turning direction.

When the page turning operation is found faithful to a program, the booklet T is sent to and processed in a post-step. The processed booklet T is sent back to the page turning position 5 as shown in FIG. 11. In this state, the vacuum pad 10*a* sucks and picks up the page Ta as shown in FIG. 12. When the picked-up page Ta is detected by the page pickup sensor 19, the movable guide 20*a* moves to the right together with the pinch-roller 21*a* and bladed wheel 22*a*, and goes into the lower part of the page Ta, as shown in FIG. 13. Then, the booklet T is conveyed to the left by the rotation of the conveying rollers 2*b*, 2*c* and 2*d* in the direction of arrow, and the plate Ta contacts the pinch-roller 21*a* and is rotated in the closing direction, as shown in FIG. 14. Further, as shown in FIG. 15, the booklet T is conveyed to the right, the page Ta is rotated in the closing direction and closed, and the page closing operation is completed. In the page closing operation, the vacuum pad 10*a* is retreated to the lower right direction from the standby position, to prevent from contacting the page Ta rotating largely in the closing direction.

As described above, according to this embodiment, as the page Ta is picked up and turned over by the sucking force of the vacuum pad 10*a*, the page Ta is exposed to no deforming load, and the page can be turned forward and rearward irrespective of the rigidity, friction coefficient and other properties of the page.

Further, as the pinch-roller 21*a* (or 21*b*) goes into the lower part of the page Ta pickup up by the vacuum pad 10*a*, and contacts the page Ta, the page can be opened by small amount of pickup, or movement by the vacuum pad 10*a*, and can be laid out equivalent to a conventional page turning apparatus using buckling distortion.

Further, the maximum retreat position of the vacuum pad 10*a* in the page turning operation coincides with the rearward page turning start position, and forward and rearward page turning are possible in a compact range.

Further, the opened page number is detected by the detection sensor 24, and if the detection result is different from a predetermined page number, the turning operation is retried. Therefore, exact page turning is possible.

FIGS. 16A to 22C show a page turning apparatus according to a second embodiment of the invention.

The same parts as those of the first embodiment are given the same numbers, and a detailed explanation thereof is omitted.

FIGS. 16A to 16C and FIGS. 17A to 17C show an operation of turning a front cover of a booklet. FIGS. 18A to 18C and FIGS. 19A to 19C show an operation of turning body pages. FIGS. 20A to 20C and FIGS. 21A to 21C show an operation of turning back body pages.

In the second embodiment, a pickup hold guide 35 is provided in the contact feed mechanisms 20A and 20B. When the page sucked and pickup up by the upper-side vacuum pad 10*a* accidentally falls, the pickup hold guide 35 holds the fallen page.

Further, the page number detection sensor 24 is provided in the contact feed mechanism 20B as a unit, and is moved together with the contact feed mechanism 20B. The page number detection sensor 24 needs to move toward the booklet T when reading the number of the booklet T. As the page number detection sensor 24 moves together with the contact feed mechanism 20B, no additional device is required to move the page number detection sensor 24. This contributes to make the apparatus compact.

Figure 22A:
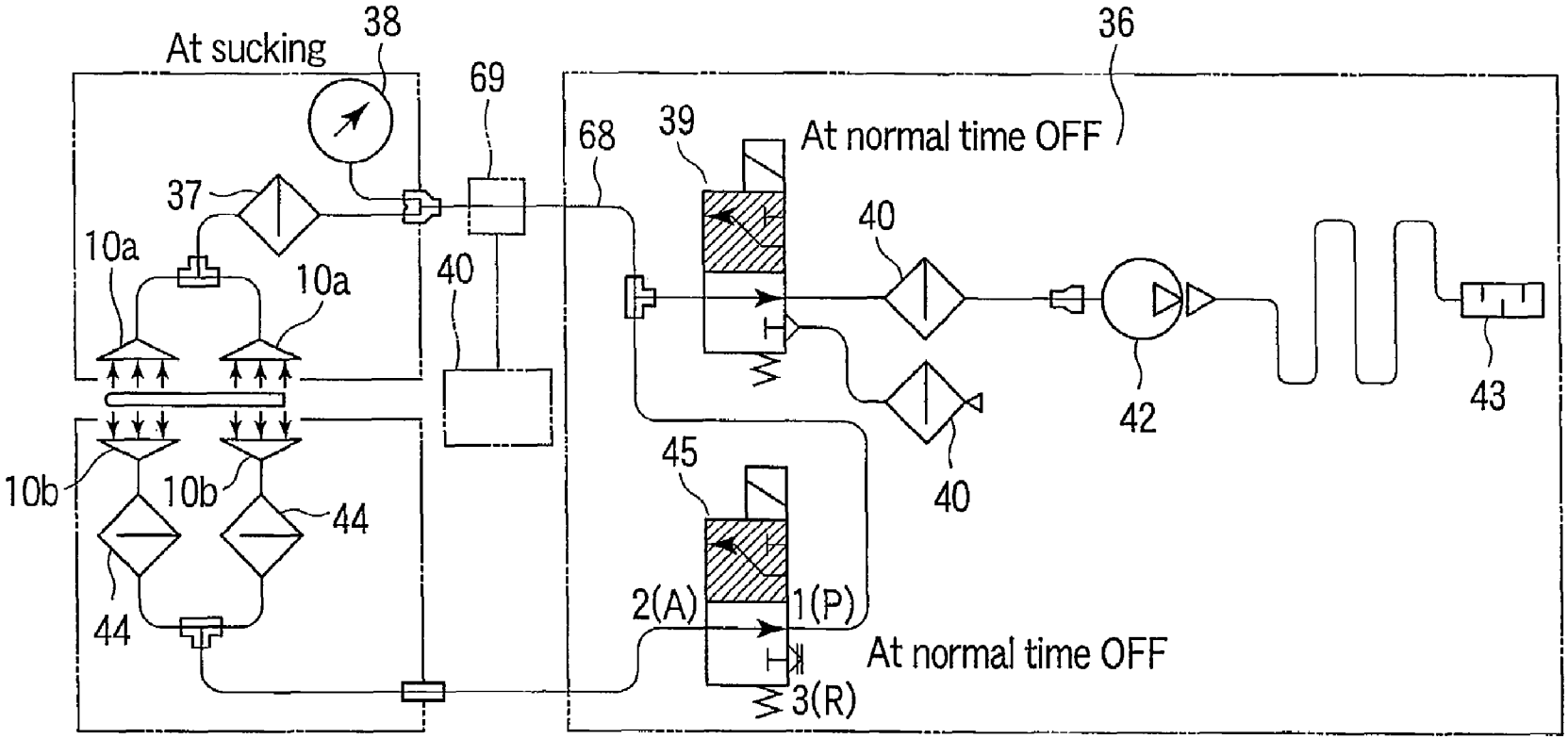
FIG. 22A is a diagram showing a negative pressure generation circuit of a vacuum pad of the page turning apparatus.
Figure 22B:
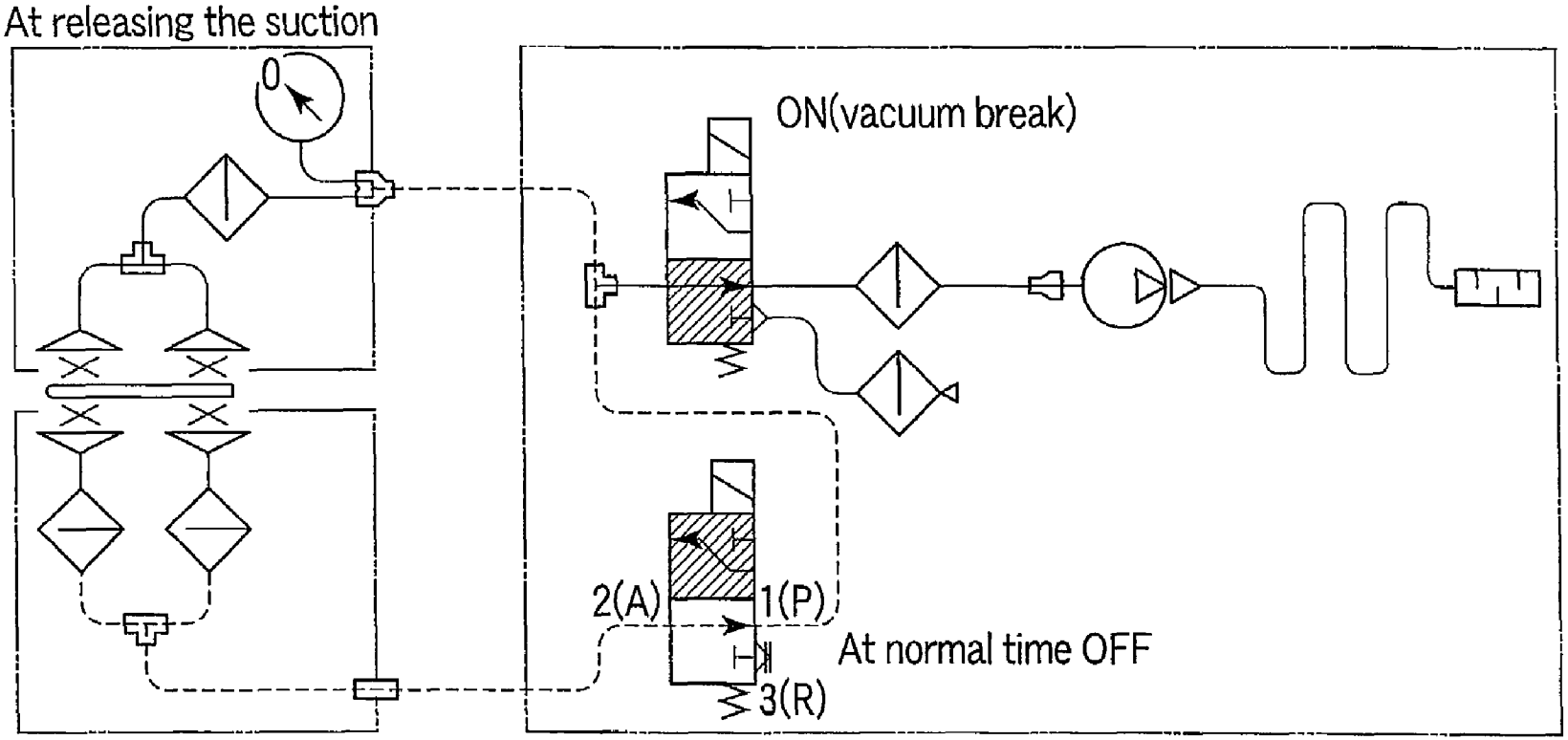
FIG. 22B is a diagram showing a negative pressure generation circuit of a vacuum pad of the page turning apparatus.
Figure 22C:
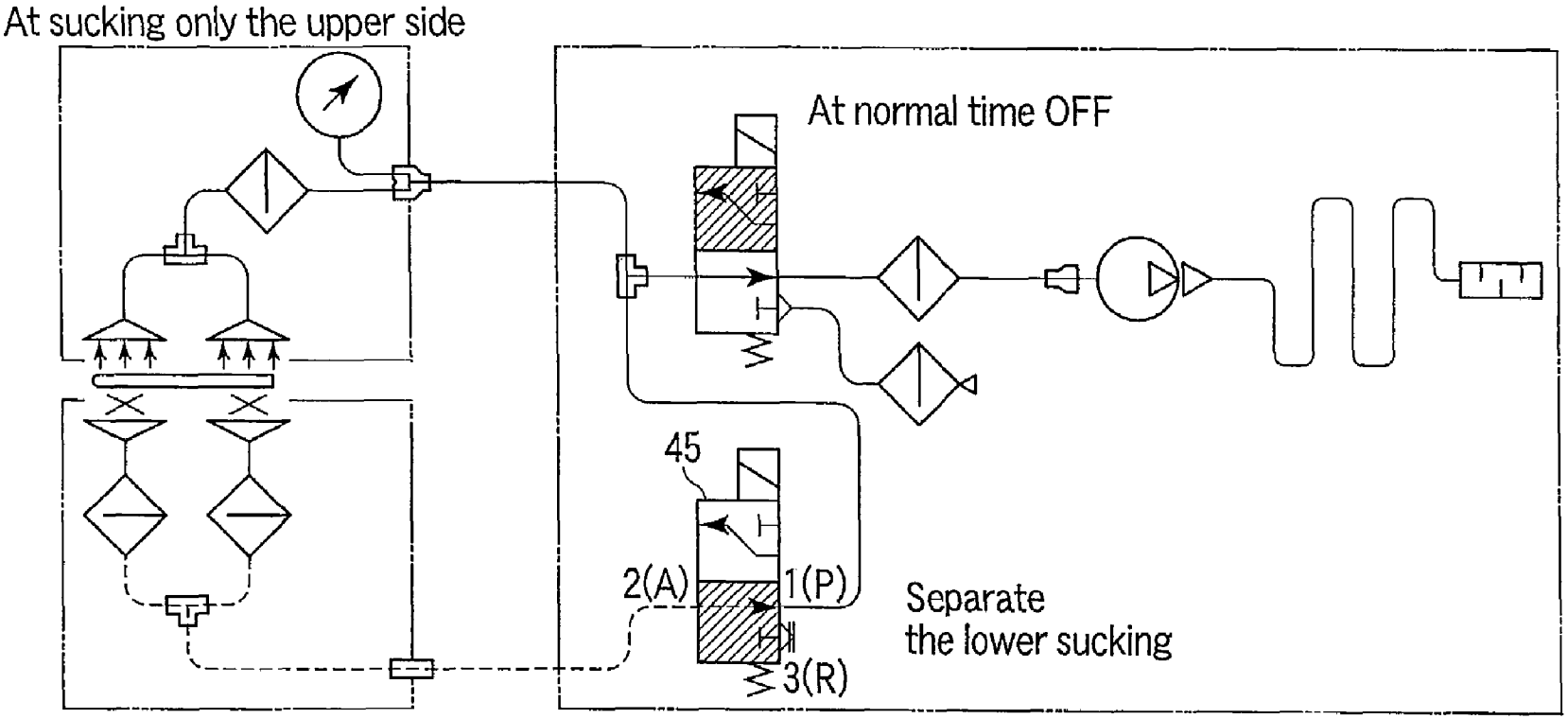
FIG. 22C is a diagram showing a negative pressure generation circuit of a vacuum pad of the page turning apparatus.

Further, the upper-side and lower-side vacuum pads 10*a* and 10*b* are connected to a negative pressure generation mechanism 36 as shown in FIGS. 22A to 22C. Namely, the upper-side vacuum pad 10*a* is connected to a filter 37, a pressure gauge 38, a first solenoid valve 39, and a vacuum pump 42 through a filter 40. The vacuum pump 42 is connected to a silencer 43. The lower vacuum pad 10*b* is connected to the upstream side of the first solenoid valve 39 through a filter 44 and a second solenoid valve 45.

FIG. 22A shows the state in which a suction force is generated in the upper-side and lower-side vacuum pads 10*a* and 10*b*. FIG. 22B shows the state in which the first solenoid valve 39 is switched and the suction forces of the upper-side and lower-side vacuum pads 10*a* and 10*b* are eliminated. FIG. 22C shows the state in which the first and second solenoid valves 39 and 45 are switched, a suction force is generated in the upper-side vacuum pad 10*a*, and the suction force of the lower vacuum pad 10*b* is eliminated.

Next, an explanation will be given of the operation of turning the front cover Ta of the booklet T with reference to FIGS. 16A to 16C and FIGS. 17A to 17C.

Figure 16A:
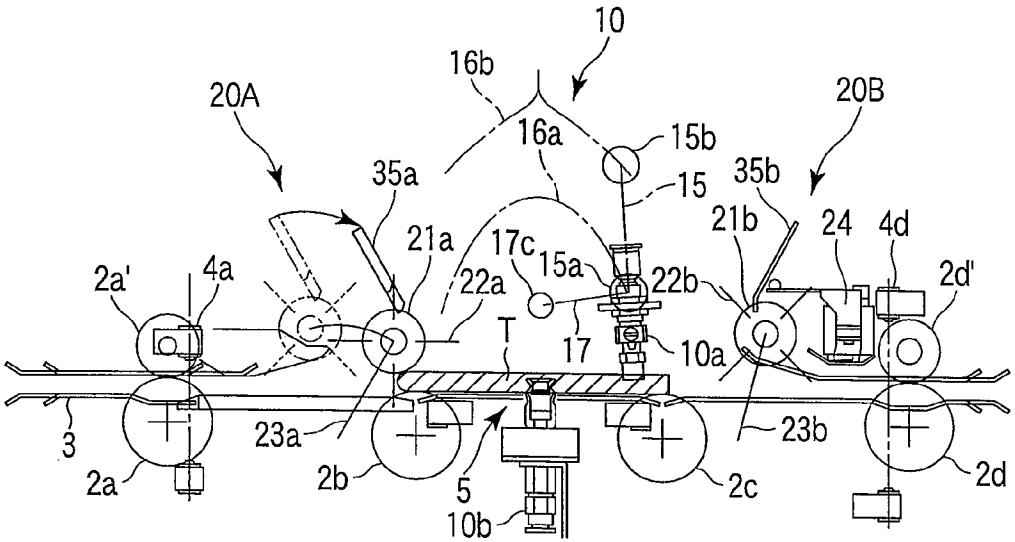
FIG. 16A is a diagram showing the operation of turning a front cover by a page turning apparatus according to a second embodiment of the invention.
Figure 16B:
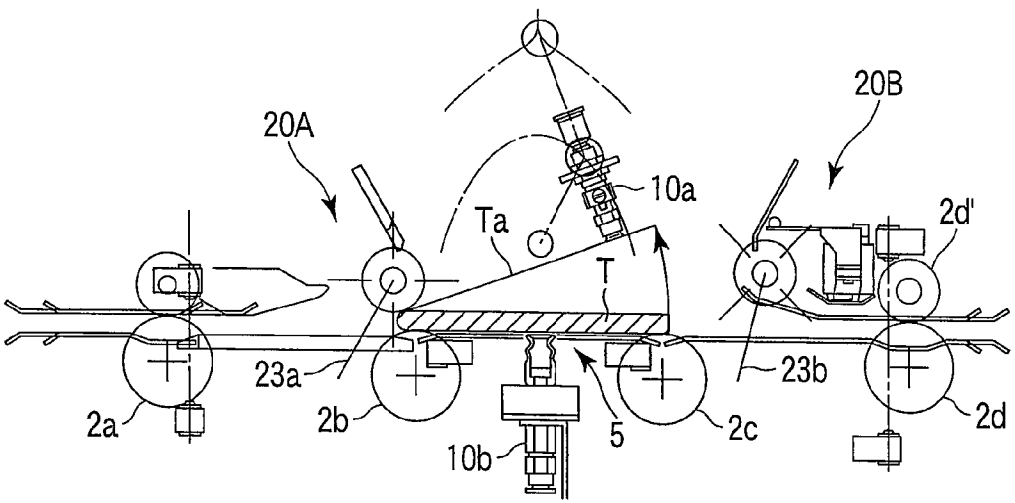
FIG. 16B is a diagram showing the operation of turning a front cover by the page turning apparatus.
Figure 16C:
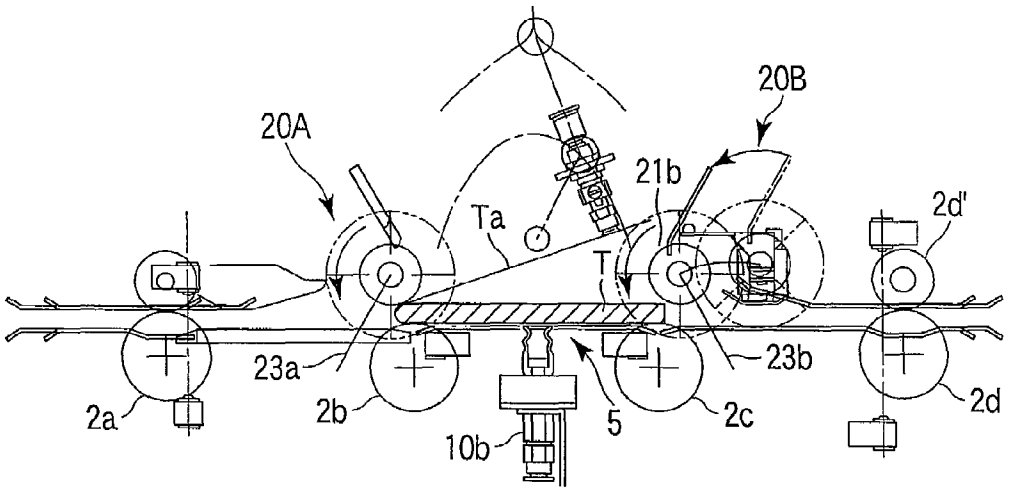
FIG. 16C is a diagram showing the operation of turning a front cover by the page turning apparatus.
Figure 17A:
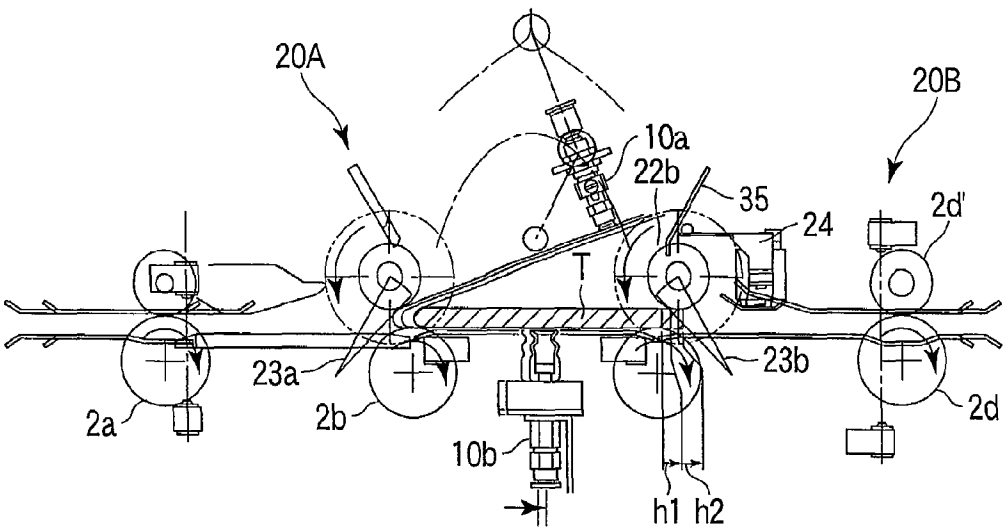
FIG. 17A is a diagram showing the operation of turning a front cover by the page turning apparatus.

As shown in FIG. 16A, when the booklet T is conveyed to the page turning start position 5, the lower vacuum pad 10*b* sucks and holds the booklet, and the upper-side vacuum pad 10*a* moves down, contacts, sucks and holds the front cover Ta of the booklet T. Then, as shown in FIG. 16B, the upper-side vacuum pad 10*a* moves up along the cam grooves 16*a* and 16*b*, and picks up the front cover Ta. When the front cover Ta is pickup up to a predetermined position, the contact feed mechanism 20B moves and goes under the front cover Ta as shown in FIG. 16C. Then, the conveying roller 2*c* and pinch-rollers 21*b* holds and conveys the booklet T as shown in FIG. 17A. When the booklet T is conveyed, the operation of the first and second solenoid valves 39 and 45 is controlled and the suction of the upper-side and lower-side vacuum pads 10*a* and 10*b* is released, but the timing of releasing the suction of the vacuum pads is different. Namely, when the booklet T is conveyed by a predetermined distance h1, the suction of the lower vacuum pad 10*b* is released, and then when the booklet is further conveyed by distance h2, the suction of the upper-side vacuum pad 10*a* is released. Namely, the upper-side vacuum pad 10*a* sucks and holds the front cover Ta until the last minute not to drop the front cover Ta to the bladed wheel 22*b*. Further, at this time, if the front cover Ta is accidentally put down by the rotation of the bladed wheel 22*b*, the front cover Ta is received by the pickup hold guide 35 not to be involved into the bladed wheel 22*b*.

Figure 17B:
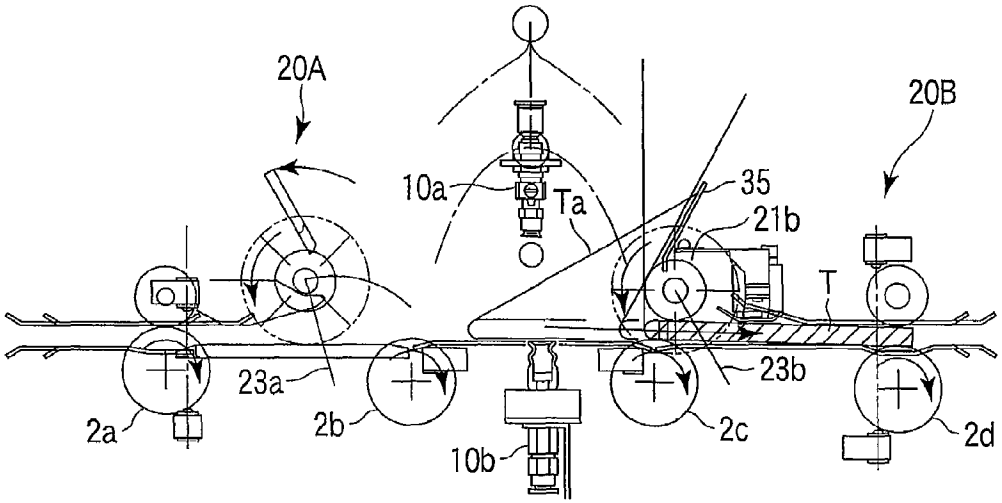
FIG. 17B is a diagram showing the operation of turning a front cover by the page turning apparatus.
Figure 17C:
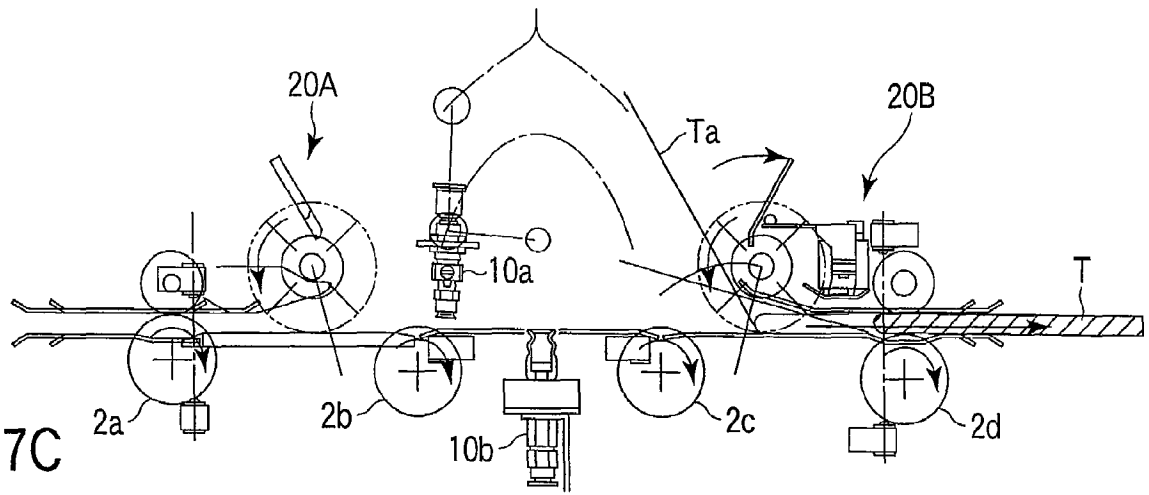
FIG. 17C is a diagram showing the operation of turning a front cover by the page turning apparatus.

The upper-side vacuum pad 10*a* is returned to the upper standby position after the suction is released, as shown in FIG. 17B. The booklet T is further held and conveyed by the conveying roller 2*c* and pinch-roller 21*b*, and the front cover Ta contacts the pinch-roller 21*b* and is turned as shown in FIG. 17C.

Next, an explanation will be given of the operation of turning a body page Tb of the booklet T with reference to FIGS. 18A to 18C and FIGS. 19A to 19C.

Figure 18A:
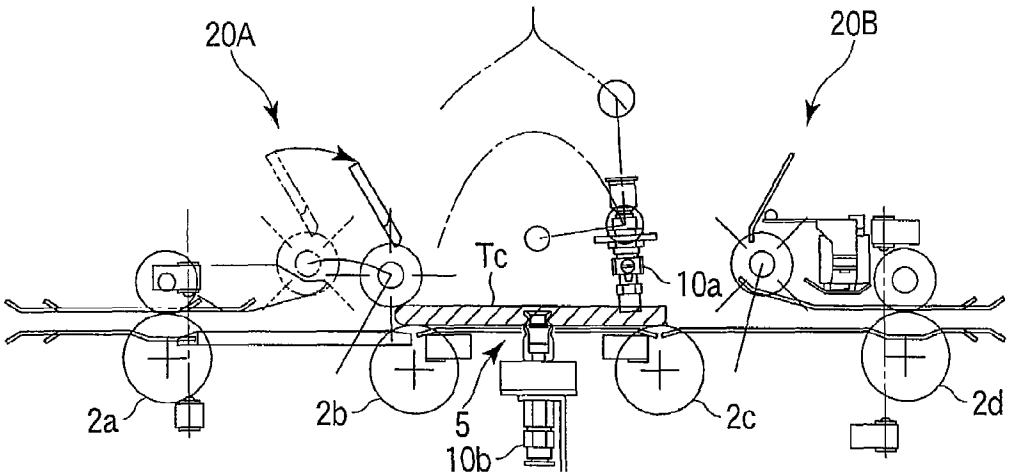
FIG. 18A is a diagram showing the operation of turning body pages by the page turning apparatus.
Figure 18B:
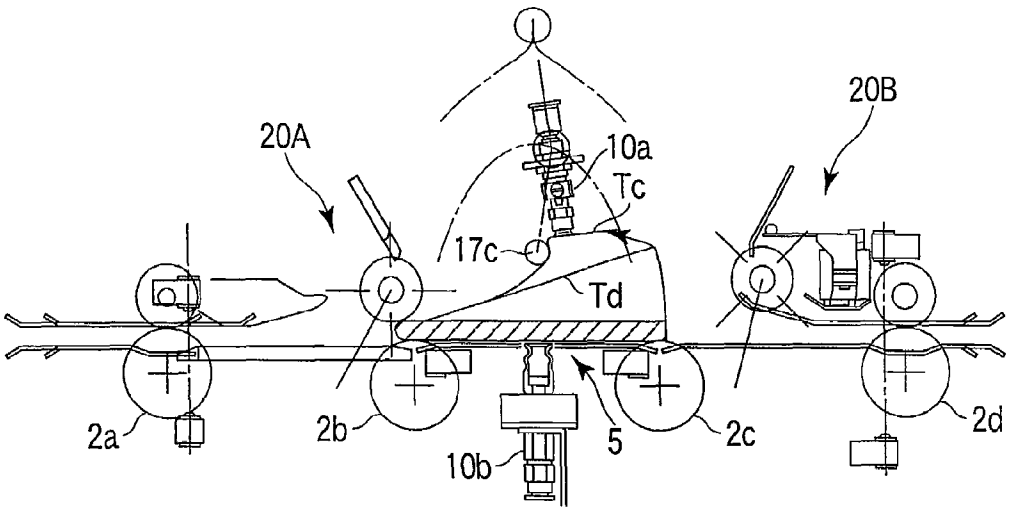
FIG. 18B is a diagram showing the operation of turning body pages by the page turning apparatus.
Figure 18C:
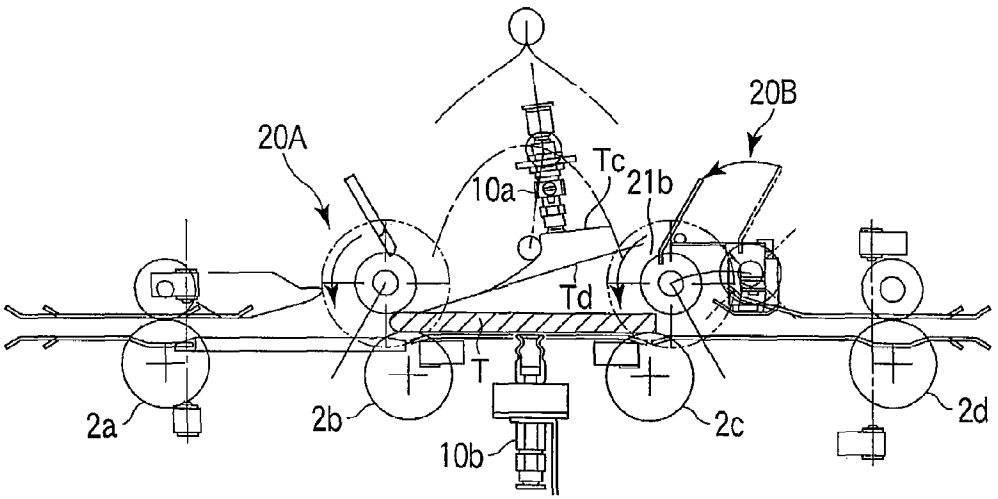
FIG. 18C is a diagram showing the operation of turning body pages by the page turning apparatus.
Figure 19A:
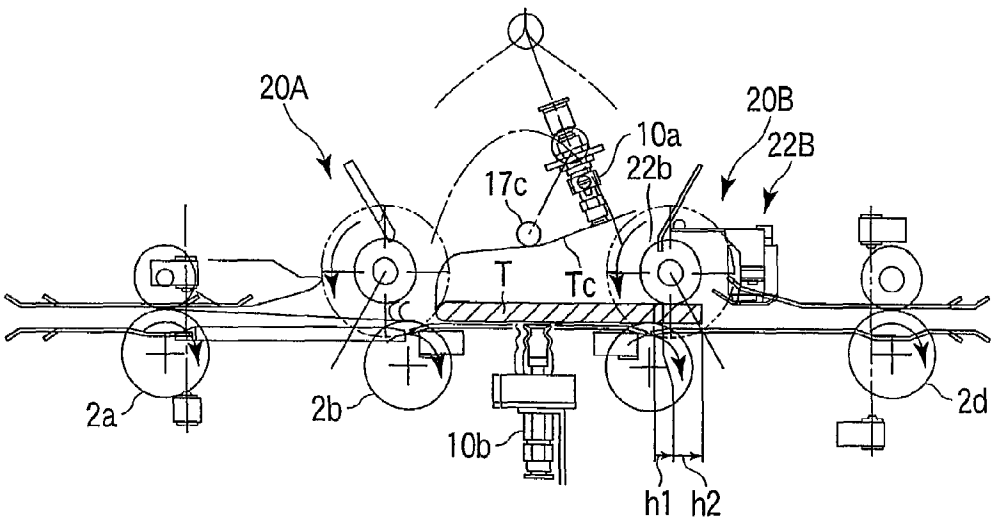
FIG. 19A is a diagram showing the operation of turning body pages by the page turning apparatus.

As shown in FIG. 18A, when the booklet T with the front cover Ta opened is conveyed to the page turning start position 5, the lower vacuum pad 10*b* sucks and holds the booklet, and the upper-side vacuum pad 10*a* moves down and contacts the uppermost body page Tc of the booklet T, and sucks and holds the body page Tc. Then, as shown in FIG. 18B, the upper-side vacuum pad 10*a* moves up along the cam grooves 16*a* and 16*b*, and picks up the body page Tc. At this time, the body page Tc contacts the drive shaft 17*c*, bends, and separates from a lower body page Td. When the body page Tc is pickup up to a predetermined position, the contact feed mechanism 20B moves and goes under the body page Tc as shown in FIG. 18C, and the bladed wheel 22*b* rotates and puts down a lower body page Td. Then, the conveying roller 2*c* and pinch-rollers 21*b* holds and conveys the booklet T as shown in FIG. 19A. When the booklet T is conveyed, as in the case of turning the front cover, the upper-side vacuum pad 10*a* sucks and holds the body page Tc until the last minute not to drop it to the bladed wheel 22*b*. Further, at this time, if the body page Tc is accidentally put down by the rotation of the bladed wheel 22*b*, the body page Tc is received by the pickup hold guide 35 not to be involved into the bladed wheel 22.

Figure 19B:
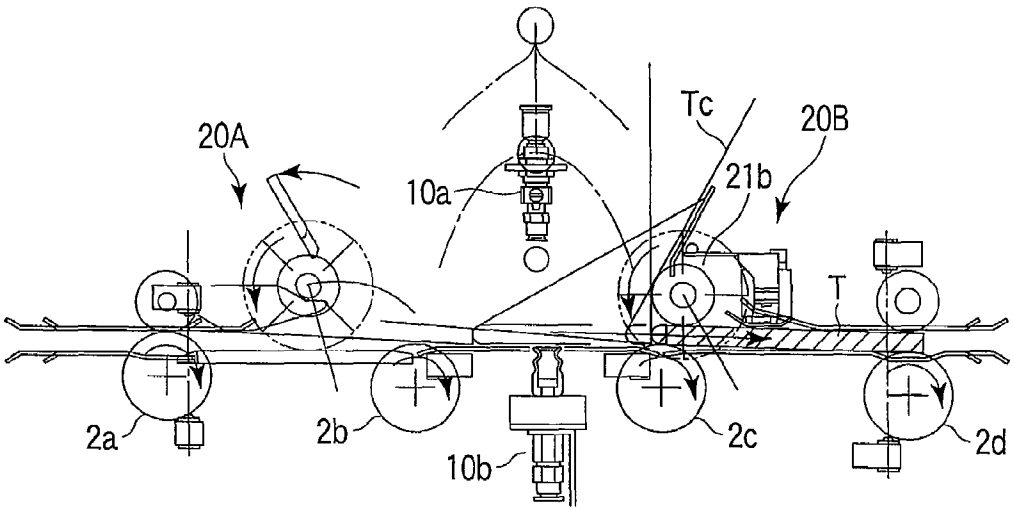
FIG. 19B is a diagram showing the operation of turning body pages by the page turning apparatus.
Figure 19C:
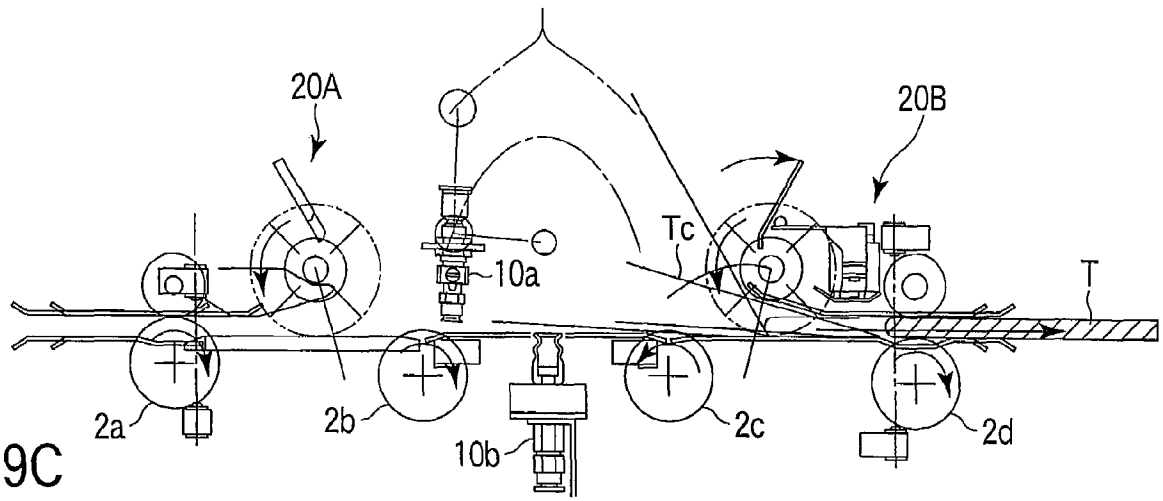
FIG. 19C is a diagram showing the operation of turning body pages by the page turning apparatus.

The upper-side vacuum pad 10*a* is returned to the upper standby position after the suction is released, as shown in FIG. 19B. The booklet T is further held and conveyed by the conveying roller 2*c* and pinch-roller 21*b*, and the body page Tc contacts the pinch-roller 21*b* and is turned as shown in FIG. 19C.

Next, an explanation will be given of the operation of turning back a body page Tc of the booklet T with reference to FIGS. 20A to 20C and FIGS. 21A to 21C.

Figure 20A:
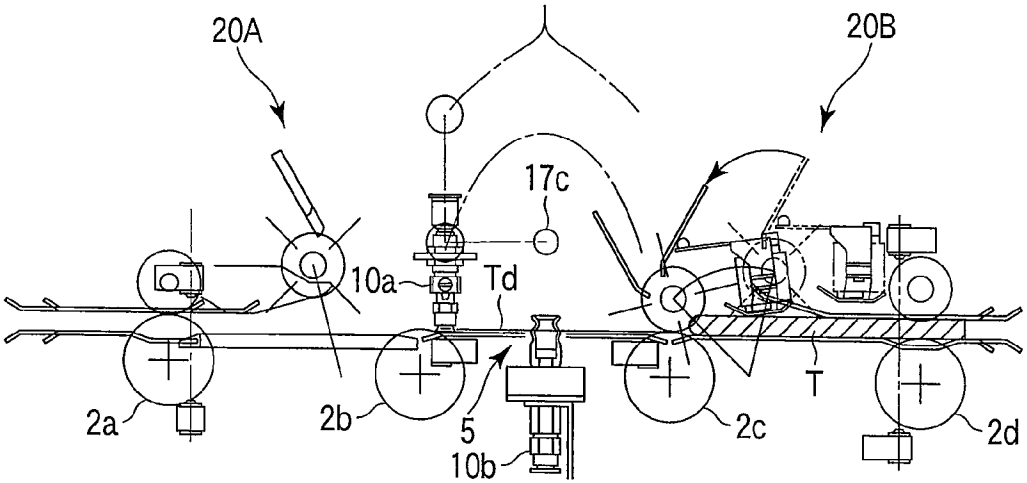
FIG. 20A is a diagram showing the operation of turning back body pages by the page turning apparatus.
Figure 20B:
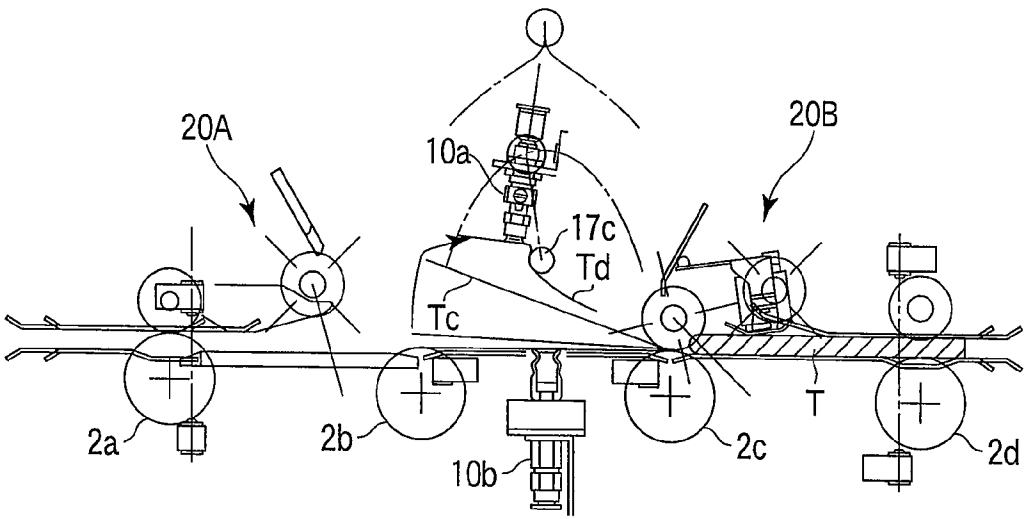
FIG. 20B is a diagram showing the operation of turning back body pages by the page turning apparatus.
Figure 20C:
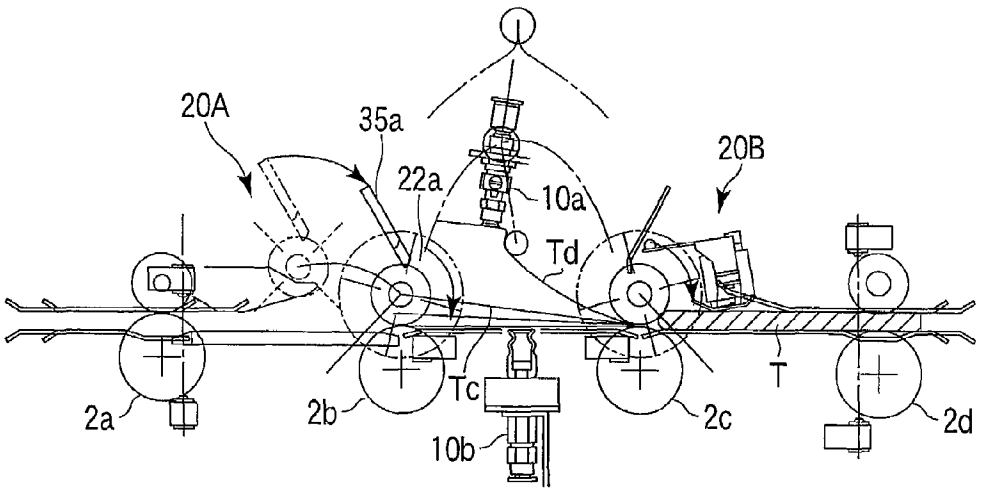
FIG. 20C is a diagram showing the operation of turning back body pages by the page turning apparatus.

As shown in FIG. 20A, when the booklet T with the body page Td opened is conveyed to the page turning start position 5, the lower vacuum pad 10*b* sucks and holds the booklet T, and the upper-side vacuum pad 10*a* moves down and contacts the upper surface of the opened body page Td, and sucks and holds it. Then, as shown in FIG. 20B, the upper-side vacuum pad 10*a* moves up along the cam grooves 16*a* and 16*b*, and picks up the body page Td. At this time, the body page Td contacts the drive shaft 17*c*, bends, and separates from the lower body page Tc. When the body page Td is pickup up to a predetermined position, the contact feed mechanism 20A moves and goes under the body page Td as shown in FIG.

20C, and the bladed wheel 22*a* rotates and puts down the lower body page Tc. At this time, if the body page Td is accidentally put down by the rotation of the bladed wheel 22*a*, the body page Td is received by the pickup hold guide 35 not to be involved into the bladed wheel 22*a*. Then, the booklet T is held and conveyed to the left by the conveying rollers 2*c* and 3*d* and pinch-rollers 21*b* and 2*d*'. When the booklet T is conveyed, as in the case of turning the front cover, the upper-side vacuum pad 10*a* sucks and holds the body page Td until the last minute not to drop it to the bladed wheel 22.

Figure 21A:
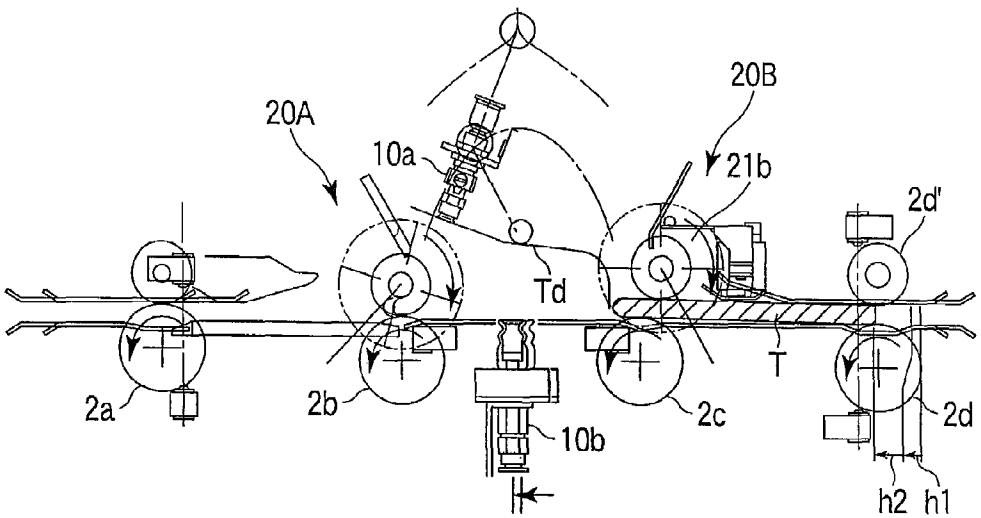
FIG. 21A is a diagram showing the operation of turning back body pages by the page turning apparatus.
Figure 21B:
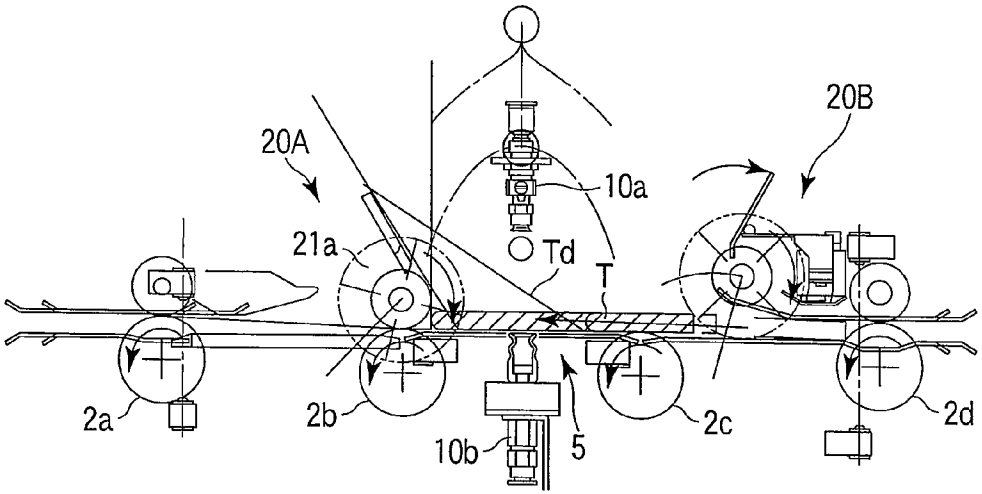
FIG. 21B is a diagram showing the operation of turning back body pages by the page turning apparatus.
Figure 21C:
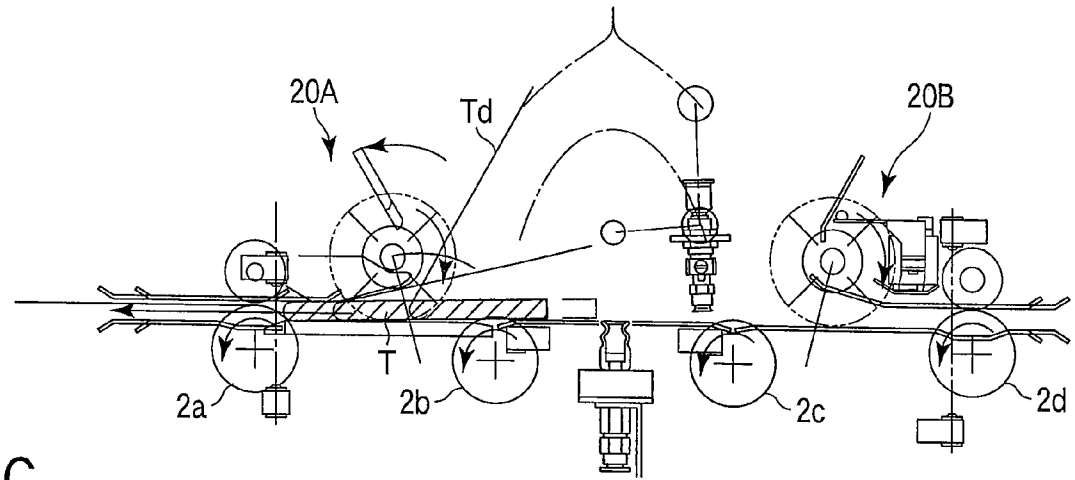
FIG. 21C is a diagram showing the operation of turning back body pages by the page turning apparatus.

The upper-side vacuum pad 10*a* is returned to the upper standby position after the suction is released, as shown in FIG. 21B. The booklet T is further held and conveyed by the conveying roller 2*b* and pinch-roller 21*a*, and the body page Tc contacts the pinch-roller 21*a* and is turned back as shown in FIG. 21C.

Figure 23A:
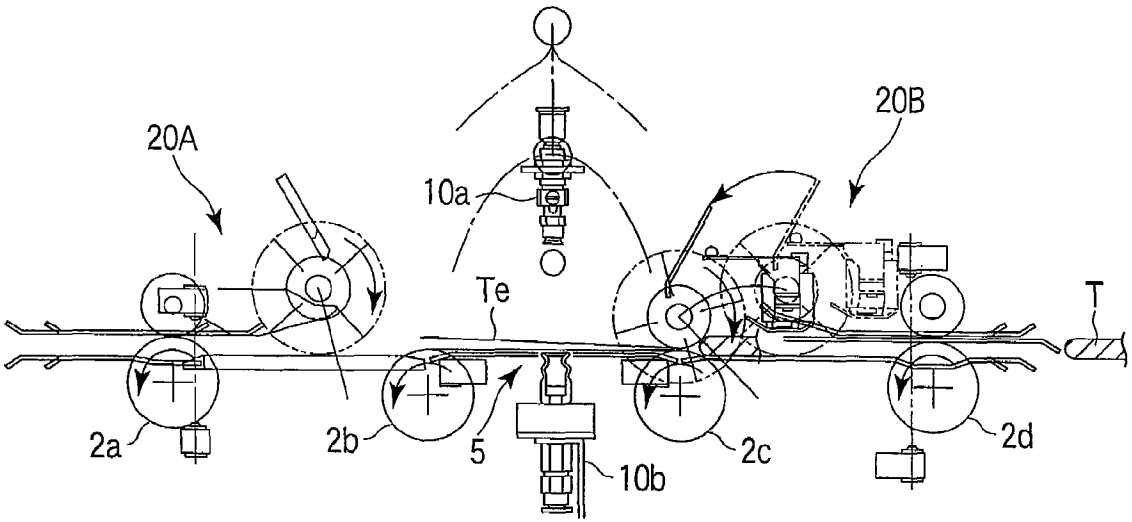
FIG. 23A is a diagram showing the operation of transferring and conveying a booklet by a booklet page turning apparatus according to a third embodiment of the invention.
Figure 23B:
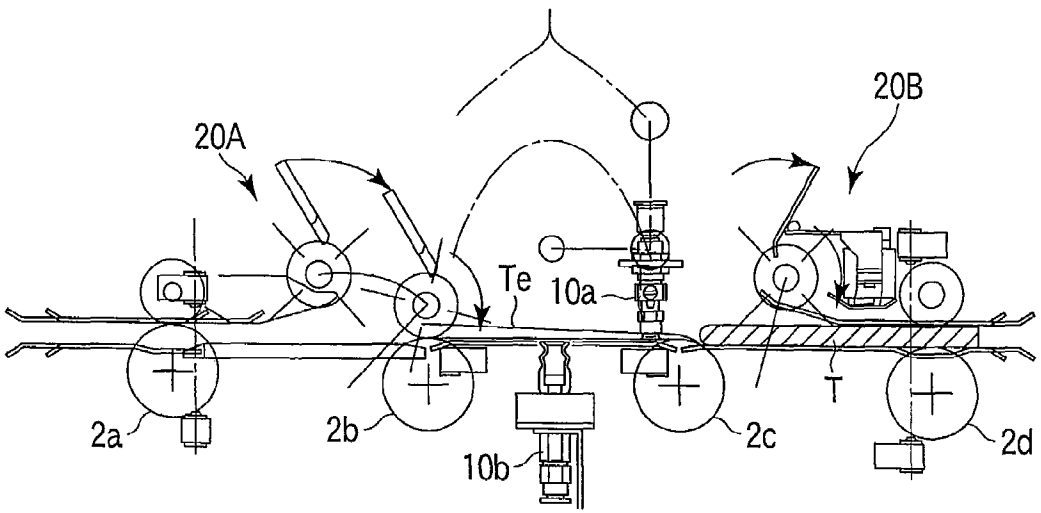
FIG. 23B is a diagram showing the operation of transferring and conveying a booklet by the page turning apparatus.
Figure 23C:
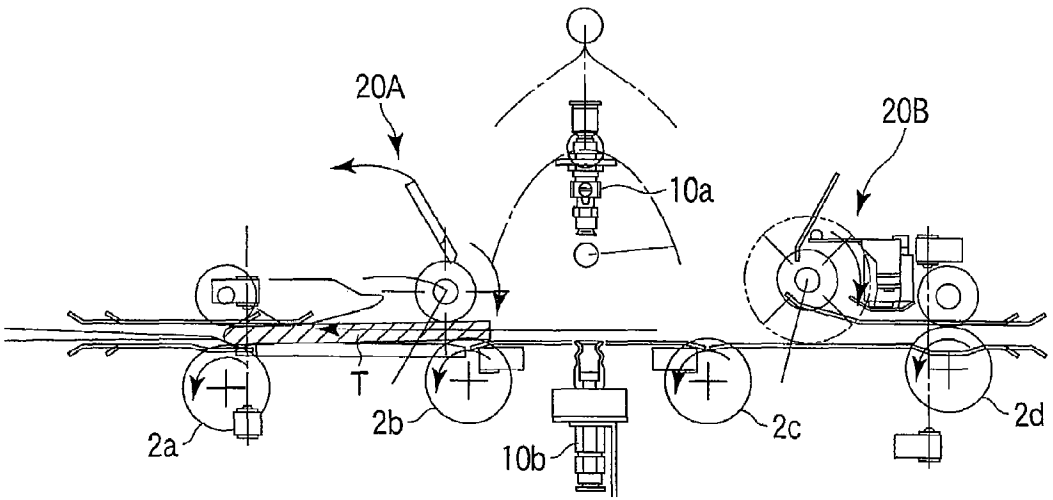
FIG. 23C is a diagram showing the operation of transferring and conveying a booklet by the page turning apparatus.

FIGS. 23A to 23C show a page turning apparatus according to a third embodiment of the invention.

The same parts as those of the embodiments described above are given the same numbers, and a detailed explanation thereof is omitted.

In a booklet publishing machine provided with a page turning apparatus, a booklet whose pages are turned to a predetermined page by the page turning apparatus is conveyed to a printing unit, and the opened predetermined page is printed or subjected to other processing.

Namely, in a booklet publishing machine, it is necessary to convey (transfer) a booklet with a predetermined page opened or closed to pre and post processing units along a conveying path in the page turning apparatus.

In a prior art, an upper conveying guide plate is provided above a position of turning pages. When a page is turned, the upper guide plate is retreated not to interrupt the page turning operation. When a booklet is transferred and conveyed, the upper guide is returns to its normal position to satisfactorily convey a booklet even if a page edge of a booklet is turned up or a booklet itself is accustomed to close.

However, use of the upper guide increases the number of parts and costs.

In the third embodiment, a booklet can be satisfactorily transferred and conveyed without using the upper guide.

Namely, in the third embodiment, as shown in FIG. 23A, the booklet T conveyed from the right side of the apparatus with a page Te opened is conveyed by the pinching operation of the contact feed mechanism 20B at the exit, and once stopped at the page turning position 5. Then, before transferring the booklet T to the contact feed mechanism 20A at the entrance, the contact feed mechanism 20B at the exit is retreated, and the upper-side vacuum pad 10*a* is moved down to press the turned-up page Te, as shown in FIG. 23B, thereby providing the same function as the upper guide. Then, the contact feed mechanism 20A at the entrance pinches the page Te, and the upper-side vacuum pad 10*a* moves up and returns to the standby position. After the vacuum pad 10*a* returns to the standby position, the contact feed mechanism 20A pinches and conveys the booklet T to the left side of the apparatus. When the booklet T passes through the contact feed mechanism 20A (detected by the sensor 4*b*) on the way to the left side, the contact feed mechanism 20A returns to the standby position.

FIGS. 24A to 24C and FIGS. 25A to 25C show a page turning apparatus according to a fourth embodiment of the invention.

The same parts as those of the embodiments described above are given the same numbers, and a detailed explanation thereof is omitted.

The booklet T may need to be processed on a page close to the back cover to be found by turning pages from the back cover, in addition to a page close to the front cover to be found by turning pages from the front cover. To perform the processing continuously, the following methods are required in a conventional method.

(1) Convey a booklet once back to a booklet input part, and asks the operator to input a booklet by turning the back cover up.

(2) Repeat turning body pages up to a predetermined page close to the back cover.

However, the method (1) is troublesome for the operator, and the processing time increase as the number of pages of a booklet increases in the method (2).

To resolve these problems, after the page close to the front cover is processed, a booklet is once folded and closed, and turned over (with the rear cover up) by a booklet turn-over apparatus connected to a page turning apparatus, and then the pages are turned from the back cover in the page turning apparatus.

A booklet turn-over apparatus has a booklet holder plate to hold a booklet conveyed to the apparatus, and a booklet is turned up by turning the booklet holder plate 180° by a turning mechanism. An opened booklet folding apparatus may be connected to the page turning apparatus on the conveying path, like the booklet turn-over apparatus.

However, if the page turning apparatus can fold a booklet, it is convenient to use, and may not increase the size of a booklet publishing machine.

In the fourth embodiment, the page turning apparatus can fold a booklet.

Next, an explanation will be given of the operation of folding the front cover Ta of the booklet T with reference to FIGS. 24A to 24C and FIGS. 25A to 25C.

Figure 24A:
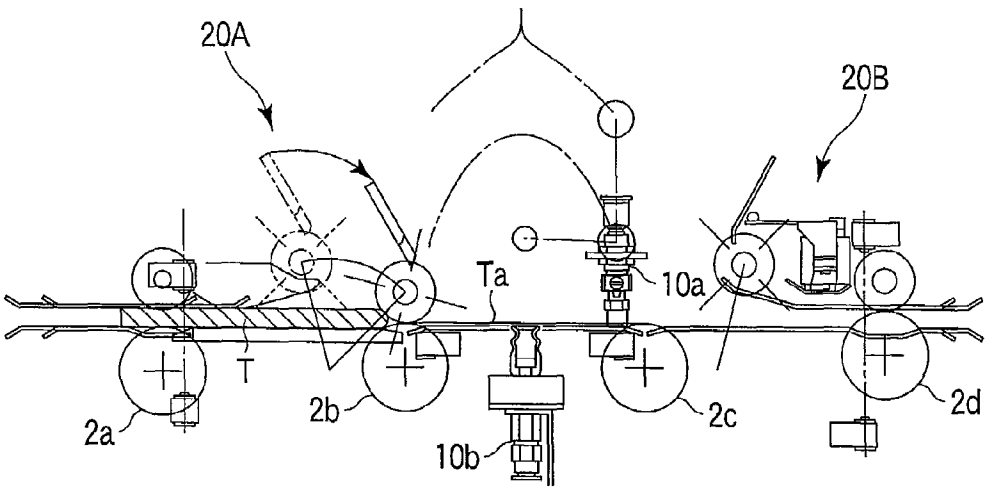
FIG. 24A is a diagram showing the operation of turning pages by a page turning apparatus according to a fourth embodiment of the invention.
Figure 24B:
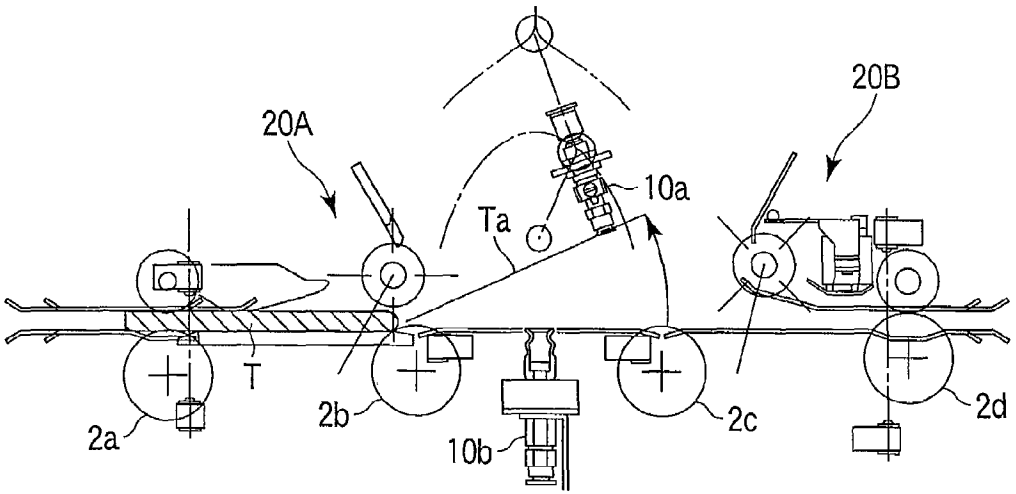
FIG. 24B is a diagram showing the operation of the page turning apparatus.
Figure 24C:
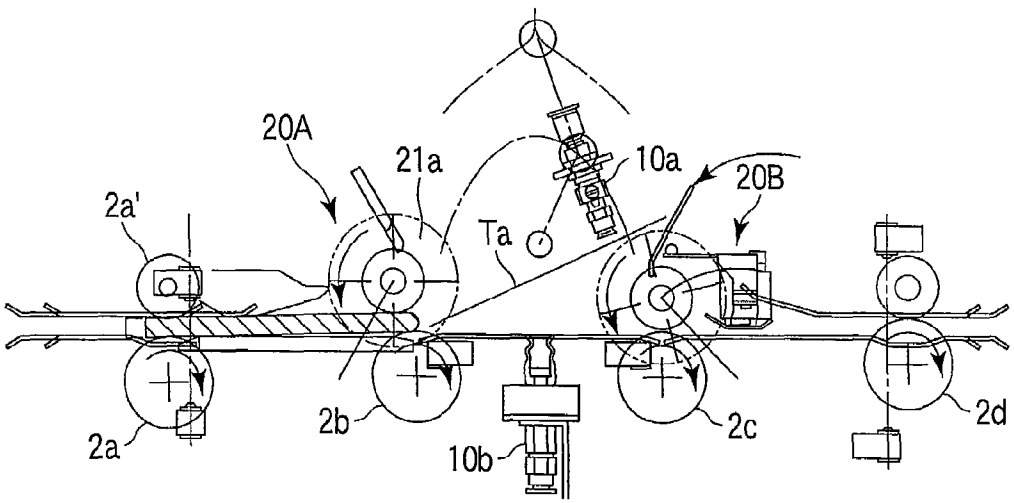
FIG. 24C is a diagram showing the operation of the page turning apparatus.
Figure 25A:
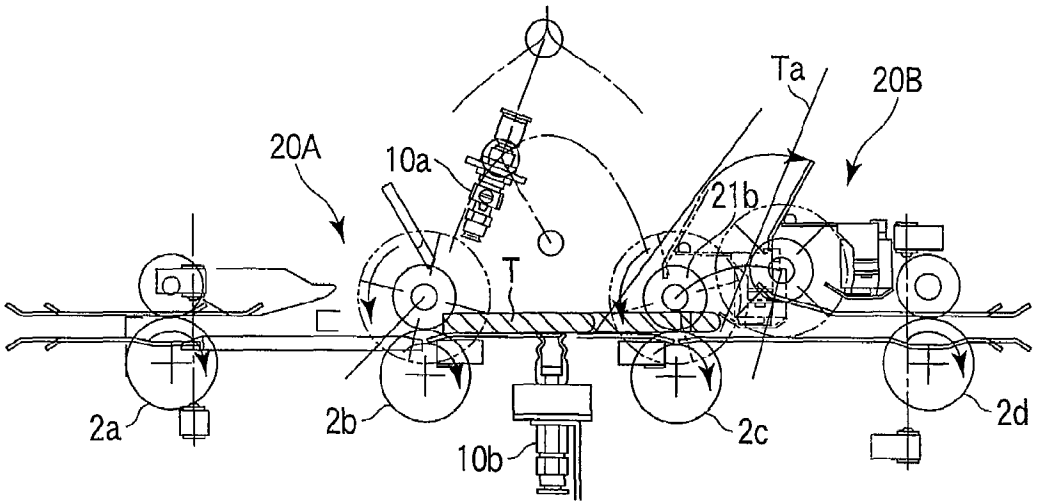
FIG. 25A is a diagram showing the operation of the page turning apparatus.
Figure 25B:
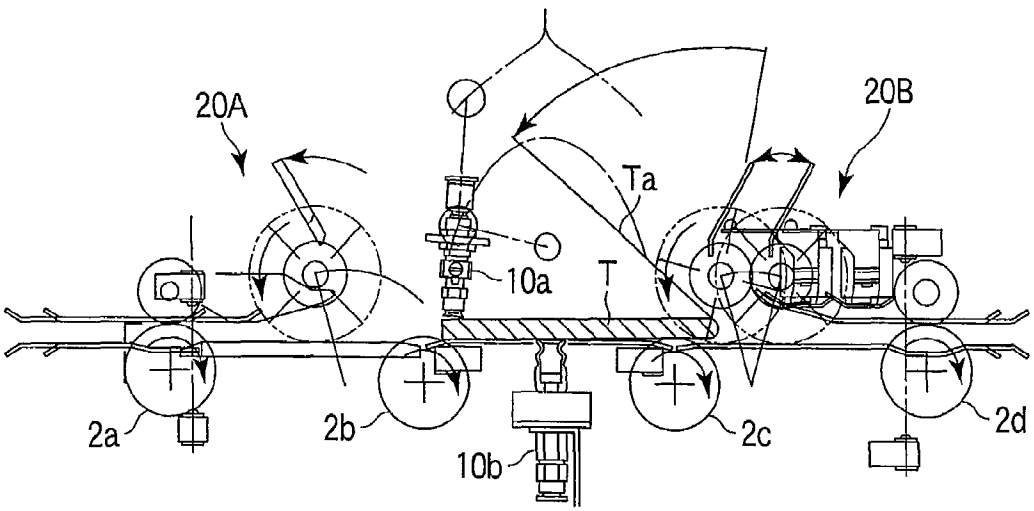
FIG. 25B is a diagram showing the operation of the page turning apparatus.
Figure 25C:
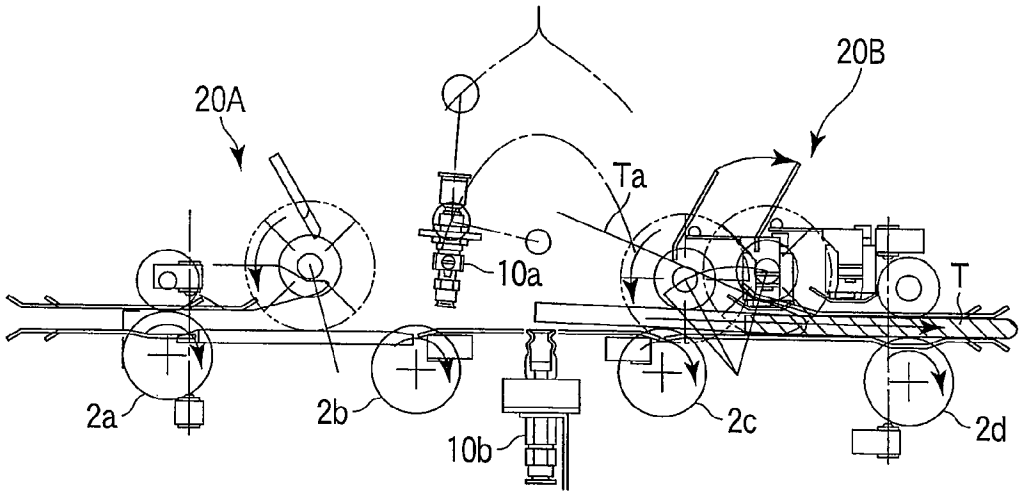
FIG. 25C is a diagram showing the operation of the page turning apparatus.

As shown in FIG. 24A, the booklet T with the front cover Ta opened is conveyed to the page turning start position 5, the upper-side vacuum pad 10*a* moves down, contacts the upper surface of the opened front cover Ta, and sucks and holds the front cover. At this time, the suction/holding by the lower vacuum pad 10*b* is released. Then, the upper-side vacuum pad 10*a* moves up along the cam grooves 16*a* and 16*b*, and picks up the front cover Ta, as shown in FIG. 24B. When the front cover Ta is picked up to a predetermined position, the contact feed mechanism 20B moves and goes under the front cover Ta, as shown in FIG. 24C. Then, the booklet T is held and conveyed to the right by the conveying rollers 2*a* and 2*b* and pinch-rollers 2*a*' and 21*a*, and the suction of the upper-side vacuum pad 10*a* is released. After the suction is released, the upper-side vacuum pad 10*a* is retreated to the upper retreat position, as shown in FIG. 25A. The booklet T is further held and conveyed to the right by the conveying roller 2*c* and pinch-roller 21*b* as shown in FIG. 25B, and the front cover Ta contacts the pinch-roller 21*b*, and is rotationally moved down, and folded as shown in FIG. 21B.

FIGS. 26A to 26C and FIGS. 27A to 27C show a page turning apparatus according to a fifth embodiment of the invention.

The same parts as those of the embodiments described above are given the same numbers, and a detailed explanation thereof is omitted.

In the fourth embodiment, a booklet turn-over apparatus is provided separately from the page turning apparatus. In the fifth embodiment, a page turning apparatus is partially modified to be able to turn-over a booklet.

Namely, in the fifth embodiment, a conveying belt 46 is provided under the page turning position 5. The conveying belt 46 is extended over the drive transmission parts 46*a* and 46*b* such as a pulley. The surface of the conveying belt 46 is continuously corrugated in the running direction to convey the booklet T by stopping the end of the booklet T at the corrugation. Therefore, the booklet T can be conveyed without providing pinch-rollers above the conveying path.

The conveying belt 46 may be driven from the driving source of the conveying rollers 2*a* and 2*d*, or driven from a separate exclusive driving source. In the fifth embodiment, the lower vacuum pad 10*b* is not used to turn over the booklet T.

Next, an explanation will be given of the operation of turning over the booklet T.

Figure 26A:
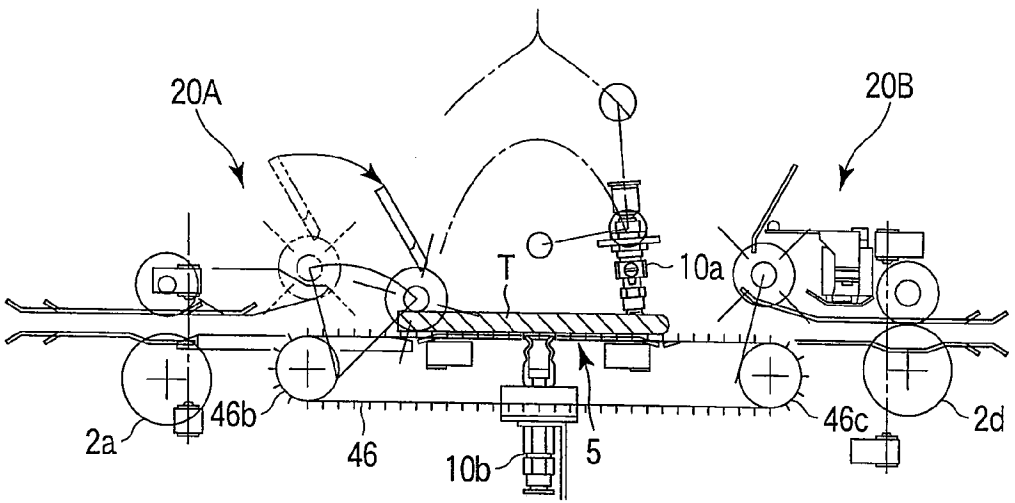
FIG. 26A is a diagram showing the operation of a page turning apparatus according to a fifth embodiment of the invention.
Figure 26B:
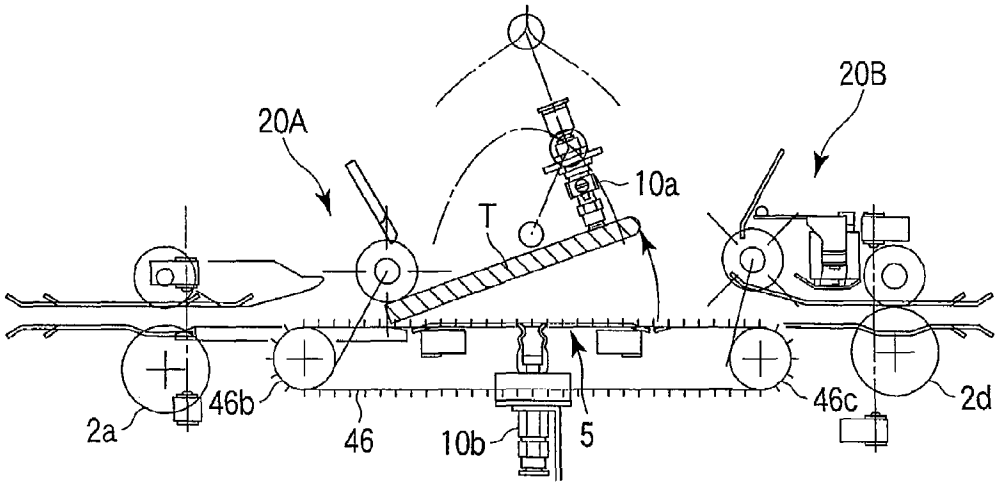
FIG. 26B is a diagram showing the operation of the page turning apparatus.
Figure 26C:
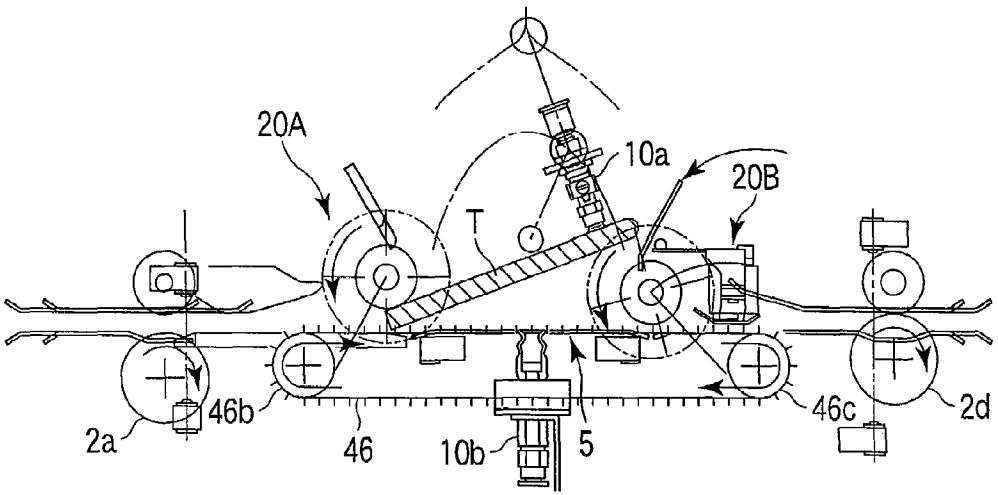
FIG. 26C is a diagram showing the operation of the page turning apparatus.
Figure 27A:
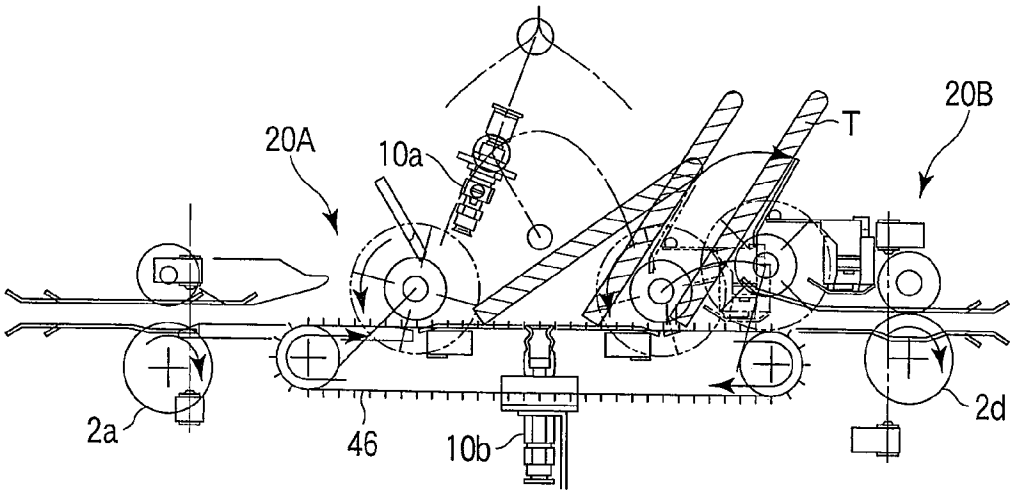
FIG. 27A is a diagram showing the operation of the page turning apparatus.
Figure 27B:
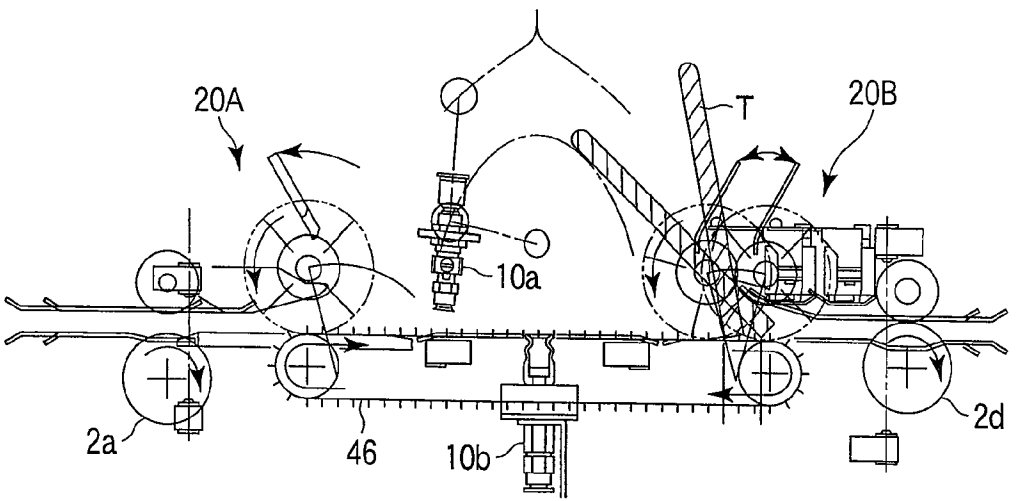
FIG. 27B is a diagram showing the operation of the page turning apparatus.
Figure 27C:
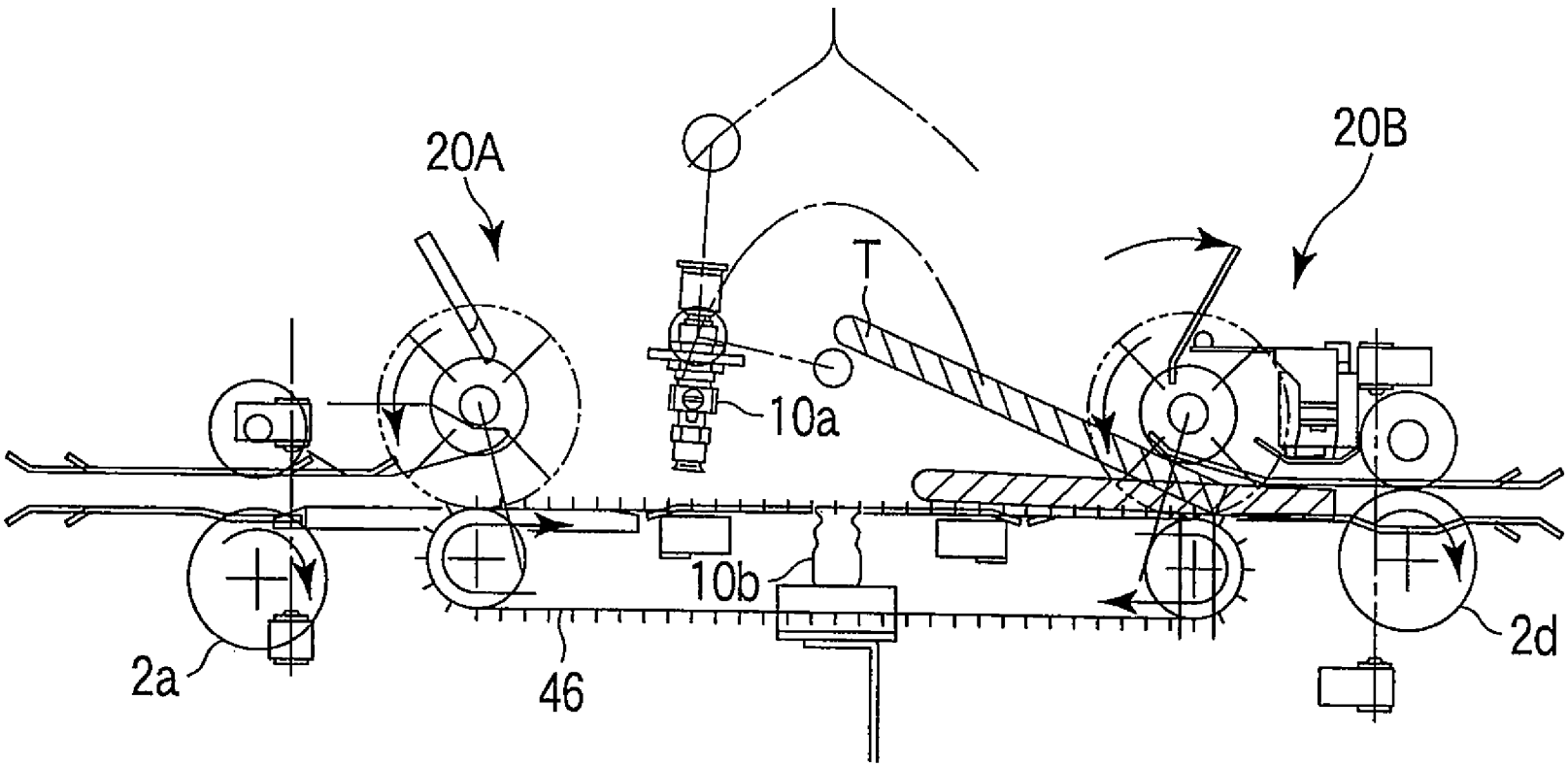
FIG. 27C is a diagram showing the operation of the page turning apparatus.

As shown in FIG. 26A, the booklet T is conveyed to the page turning start position 5, the upper-side vacuum pad 10*a* moves down, contacts the upper surface of the bound edge, and sucks and holds the booklet T. (At this time, the suction/holding by the lower vacuum pad 10*b* is released.) Then, the upper-side vacuum pad 10*a* moves up along the cam grooves 16*a* and 16*b*, and picks up the booklet T, as shown in FIG. 26B. When the booklet T is picked up to a predetermined position, the contact feed mechanism 20B moves and goes under the booklet T, as shown in FIG. 26C. Then, the conveying belt 46 runs and conveys the booklet T, the sucking of the upper-side vacuum pad 10*a* is released, and the vacuum pad 10*a* is retreated to the retreat position. As the conveying belt 46 runs, the booklet T is gradually raised, turned down after rising at 90°, and turned over 180°, as shown in FIG. 27C.

As the paging apparatus can turn over the booklet T as described above, a separate turn-over apparatus is unnecessary, and a booklet publishing machine can be made compact.

Figure 28:
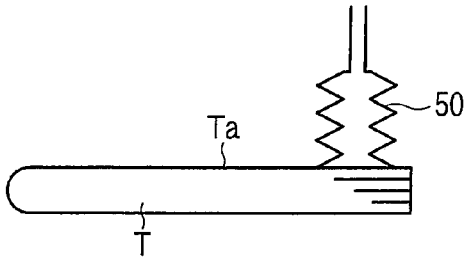
FIG. 28 is a diagram showing an example of modification of a vacuum pad.

FIG. 28 shows an example of modification of a vacuum pad.

A vacuum pad 50 is made like a bellows.

Figure 29:
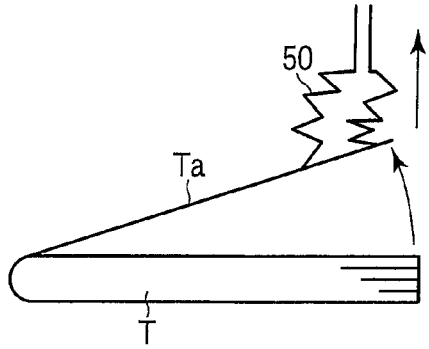
FIG. 29 is a diagram showing the operation of the vacuum pad of FIG. 28.

The vacuum pad 50 sucks the front cover Ta of the booklet T, and moves up to pick up the front cover Ta as shown in FIG. 29. At this time, the vacuum pad itself is elastically deformed to absorb the inclination incident to the pickup of the page Ta.

Figure 30:
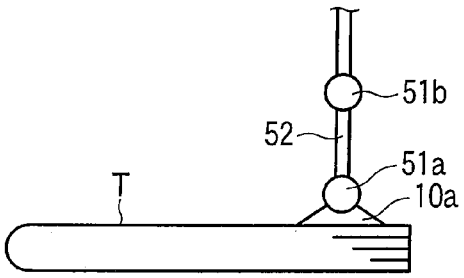
FIG. 30 is a diagram showing another holding mechanism of a vacuum pad.
Figure 31:
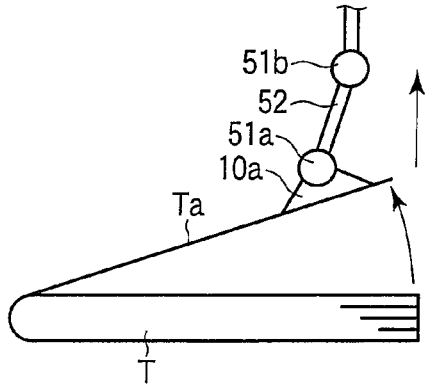
FIG. 31 is a diagram showing the operation of the holding mechanism of FIG. 30.

FIG. 30 shows the other holding mechanism of the vacuum pad 10*a*.

In FIG. 30, the vacuum pad 10*a* is held by a holding member 52 through rotary fulcrums 51*a* and 51*b*.

The vacuum pad 10*a* sucks the front cover Ta of the booklet T, and moves up to pick up the front cover Ta. At this time, the vacuum pad 10*a* rotates about the rotary fulcrum 51*a* to absorb the inclination incident to the pickup of the front cover Ta.

A member to pick up the booklet T is not limited to a vacuum pad. An adhesive board or adhesive roller may be used. It is also permitted to use a toothbrush-like member to catch and pick up a page by inserting a hook-shaped tip into the end of the booklet T.

As a member to turn down a picked-up page, any thing can be used as long as its material, shape and surface roughness do not damage the page surface. However, the insertion position (height) H of a turn-down member 52 is less than L, assuming that the distance from the bound edge to the end of the booklet T.

Figure 32:
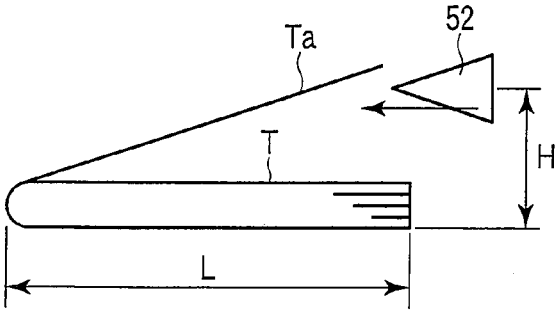
FIG. 32 is a diagram showing a contact member to contact a picked-up page of a booklet.
Figure 33:
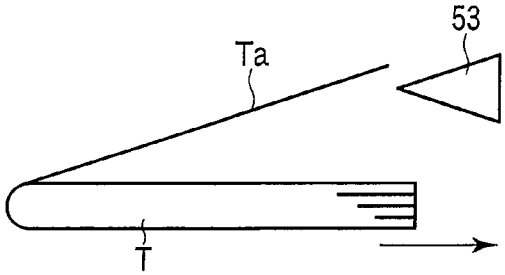
FIG. 33 is a diagram showing another contact member to contact a picked-up page of a booklet.

The turn-down member 52 may go under a picked-up page as shown in FIG. 32. Or, the turn-down member 52 may be fixed, and the booklet T is conveyed to slide the uppermost picked-up page over the turn-down member 53.

FIGS. 34 to 37 show mechanisms to put down the pages under the uppermost page Ta picked up by the vacuum pad 10*a* without using the bladed wheel 22.

Figure 34:
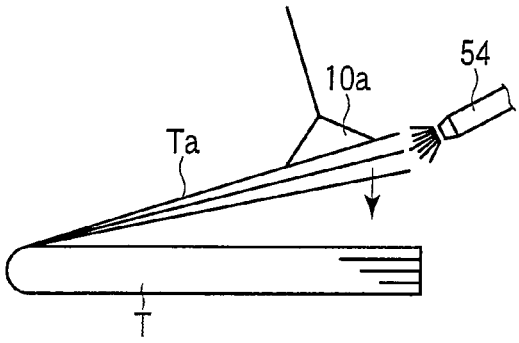
FIG. 34 is a first another example of a tap-down member to tap down the page under the picked-up page of a booklet.

FIG. 34 shows a mechanism of blowing down the pages under the page picked up by the vacuum pad 10*a* by blowing air from an air nozzle 54.

Figure 35:
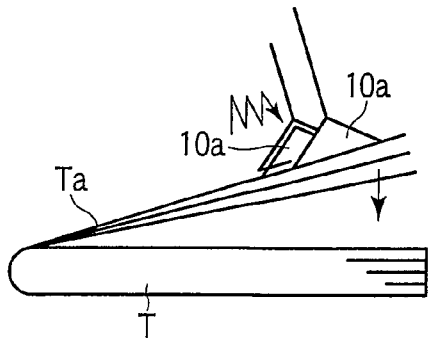
FIG. 35 is a second another example of a tap-down member to tap down the page under the picked-up page of a booklet.

FIG. 35 shows a mechanism of putting down the pages under the picked-up page by minutely and alternately vibrating the suction pads 10*a*.

Figure 36:
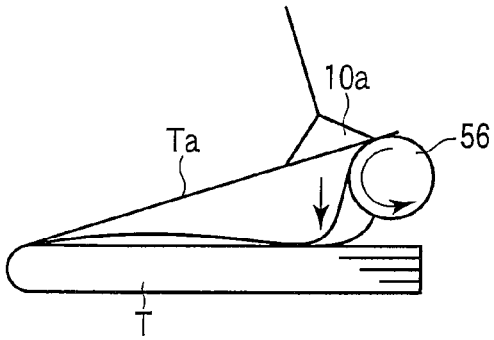
FIG. 36 is a third another example of a tap-down member to tap down the page under the picked-up page of a booklet.

FIG. 36 shows a mechanism of putting down the pages under the uppermost page by bending the pages under the picked-up uppermost page by applying a rotary roller 56 to the underside of the picked-up uppermost page and rotating the roller.

Figure 37:
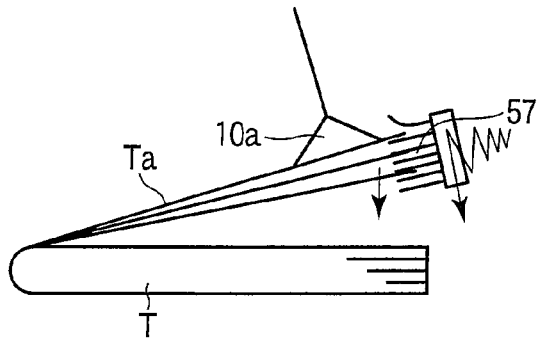
FIG. 37 is a fourth another example of a tap-down member to tap down the page under the picked-up page of a booklet.

FIG. 37 shows a mechanism of putting down the pages under the picked-up mage by vibrating and applying a toothbrush-like member 57 to the page end of the booklet T, and inserting the brush tips into the pages.

FIG. 38 to FIG. 41 shows a conveying mechanism to convey the booklet T with the uppermost page Ta picked up without using combination of a conveying roll and a pinch-roller.

Figure 38:
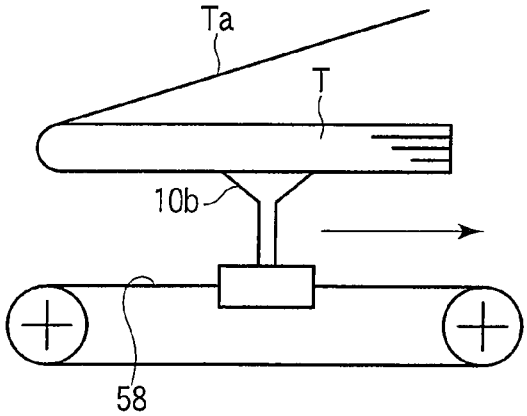
FIG. 38 is a diagram showing a first another example of a conveying mechanism to convey a booklet with a page picked up.

The conveying mechanism shown in FIG. 38 has the lower-side vacuum pad 10*b* fixed to the conveying belt 58, and conveys the booklet T by running the conveying belt 58 with the booklet T sucked and held by the vacuum pad 10*b*.

Figure 39:
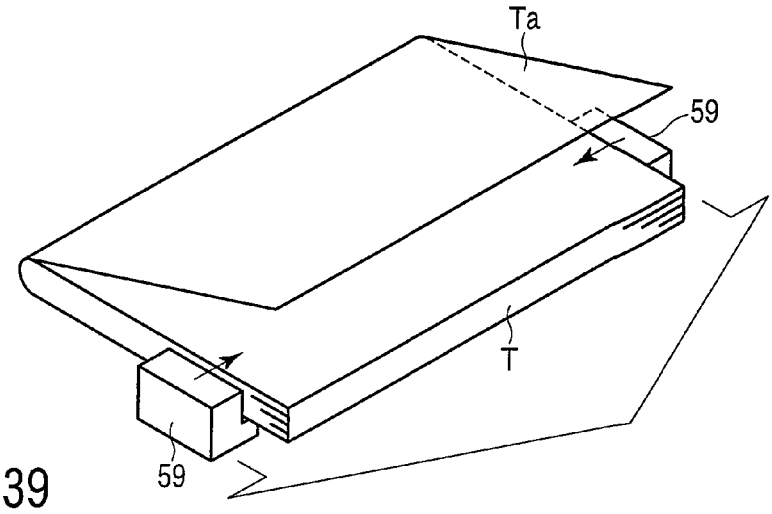
FIG. 39 is a diagram showing a second another example of a conveying mechanism to convey a booklet with a page picked up.

The conveying mechanism shown in FIG. 39 holds both ends of the booklet T with grip claws 59, and conveys the booklet T by moving the grip claw 59.

Figure 40:
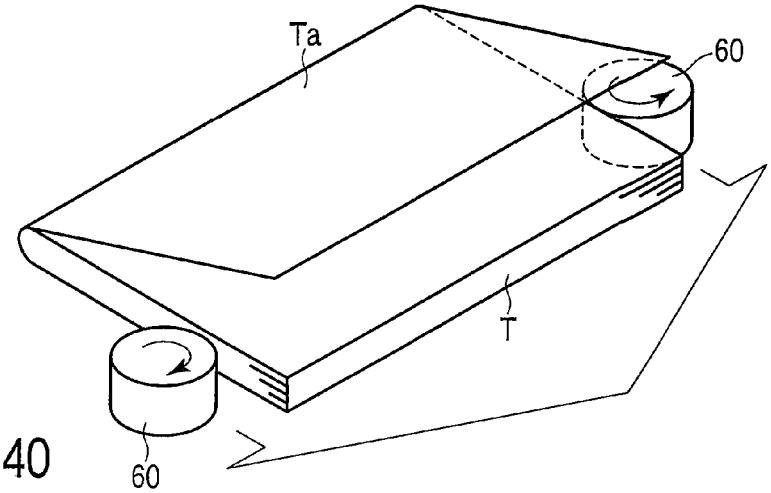
FIG. 40 is a diagram showing a third another example of a conveying mechanism to convey a booklet with a page picked up.

In the conveying mechanism shown in FIG. 40, the conveying rollers 60 contact both ends of the booklet T, and the booklet T is conveyed by rotating the conveying rollers 60.

Figure 41:
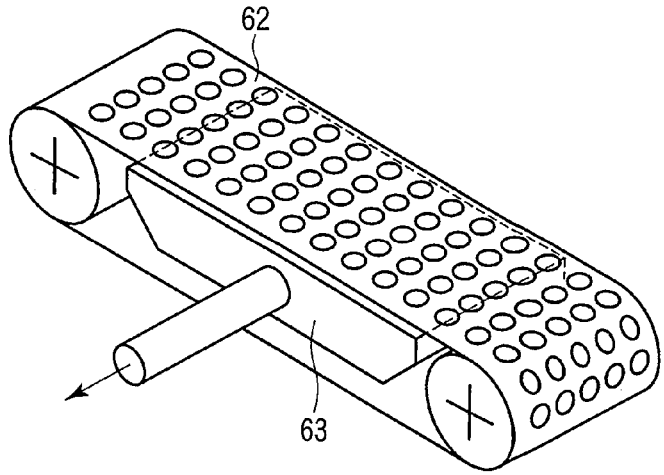
FIG. 41 is a diagram showing a fourth another example of a conveying mechanism to convey a booklet with a page picked up.

In the conveying mechanism shown in FIG. 41, a porous belt 62 is provided, a suction chamber 63 is provided under the porous belt 62, and negative pressure is generated on the porous belt 62 by sucking air by the suction chamber 63. The booklet T is held on the porous belt 62 by the negative pressure, and the booklet T is conveyed by running the porous belt 62.

The functions of picking up a page, opening a page, putting down pages under a picked-up page, and conveying a booklet described above may not be individually prepared, and may be combined.

Figure 42A:
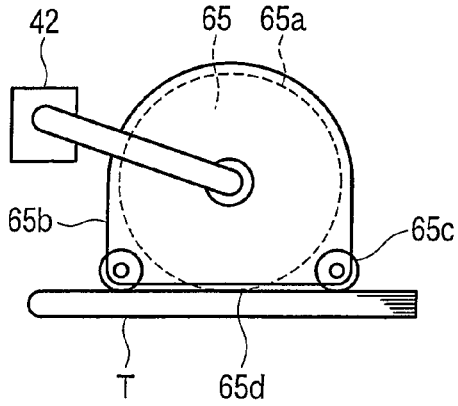
FIG. 42A is a diagram showing a mechanism to pick up and turn down a page of a booklet.
Figure 42B:
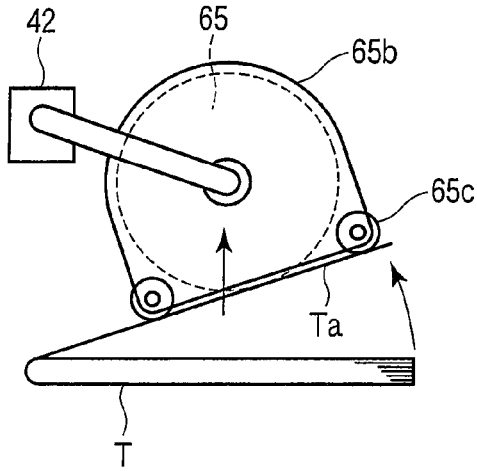
FIG. 42B is a diagram showing the operation of the page turning-down mechanism.
Figure 42C:
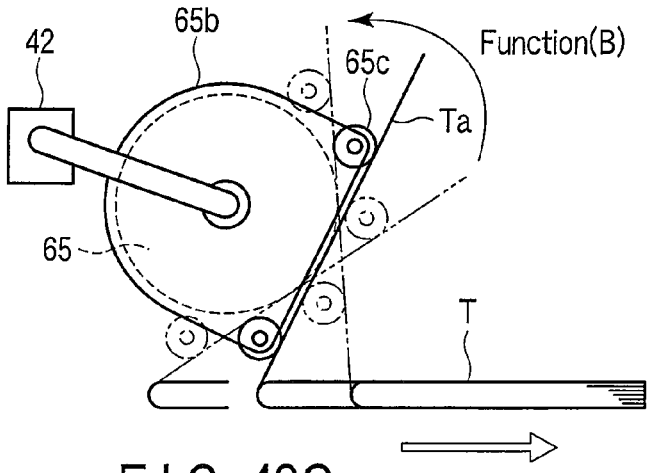
FIG. 42C is a diagram showing the operation of the page turning-down mechanism.

For example, FIGS. 42A to 42C show an example using a suction drum 65 as an element to realize the functions of picking up and opening a page.

A suction drum 65 is connected to a vacuum pump 42, keeps the inside at negative pressure, and has many small holes on the drum surface 65*a*. The drum surface 65*a* is housed in a case body 65*b* that is coaxial and rotatable with the drum 65. The lower part of the drum surface is exposed to the outside through an opening 65*d* of the case body 65*b*. The case body 65*b* is provided with small rollers 65*c* at both ends of the opening 65*d*.

When the booklet T opposes the lower part of the suction drum 65 as shown in FIG. 42A, the uppermost page of the booklet T is sucked through the small holes. When the suction drum 65 is swung upward as shown in FIG. 42B, the small rollers 65*c* move along the uppermost page of the booklet T, the case body 65*b* rotates, the exposed drum surface 65*a* rotates together, and the uppermost page Ta is picked up. After the uppermost page Ta is picked up, the booklet T is conveyed as shown in FIG. 42C, and the uppermost page Ta is sucked, held, and turned down, while changing its contact position on the drum surface 65*a*.

If a vacuum regulator 69 is inserted into a tube, which connects the vacuum pump 42 and vacuum pad 10*a* shown in FIG. 22A, and is connected to the control unit 40, the degree of vacuum can be controlled.

For example, information about a current page obtained by the page number detection sensor 24 is collated with information about optimum degree of vacuum, and the vacuum pad 10*a* can be given a suction force at the degree of vacuum optimum to that page.

For example, if the paper fibers of the body pages of the booklet T are coarse and air is likely to flow into the pages, a defect of sucking two or more pages at a time may occur. However, such a defect can be prevented by giving an appropriate suction force to the vacuum pad by the above-mentioned method.

Concretely, if the diameter of the vacuum pad 10*a* is 10 mm and the degree of vacuum is 60 kPa, a defect of concurrently sucking two or more pages is likely to occur in the body pages equivalent to Japanese writing paper due to the above-mentioned reason. However, such a defect can be practically prevented by controlling the degree of vacuum to ½ by the vacuum regulator 69.

A vacuum generating source is not limited to the vacuum pump 42. A vacuum generator (ejector) using negative pressure generated near a positive pressure blowout port of a compressor, or a device capable of changing the degree of vacuum may be used.

FIGS. 43A to 50C show cases of handling a booklet conveyed in various conditions.

There are various structures and number of pages of a booklet. Normal handling means turning the front cover Ta of the booklet T bound at the left-side edge as shown in FIG. 43A.

On each page of the opened booklet T, signs meaning a page number is given at vertically symmetric positions and shape, which are detected by the page number detection sensor 24.

FIGS. 43A to 43D show the operation of handling the booklet T input in normal conditions.

Figure 43A:
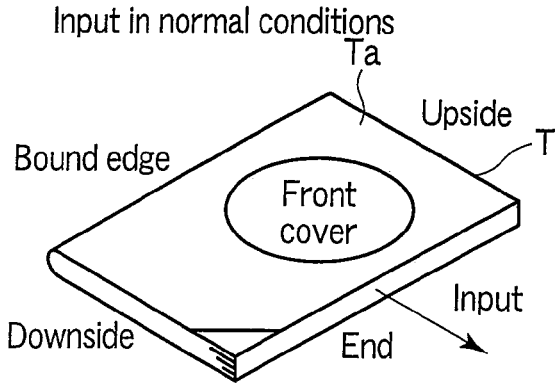
FIG. 43A is a diagram showing the operation of turning pages of a booklet input in normal conditions.
Figure 43B:
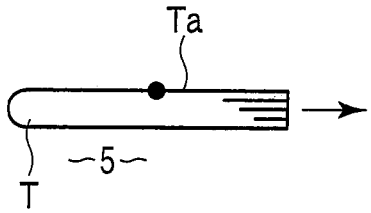
FIG. 43B is a diagram showing the page turning operation.
Figure 43C:
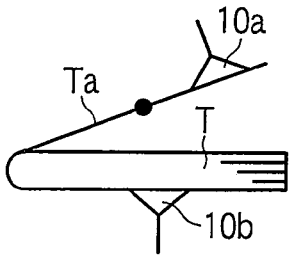
FIG. 43C is a diagram showing the page turning operation.
Figure 43D:
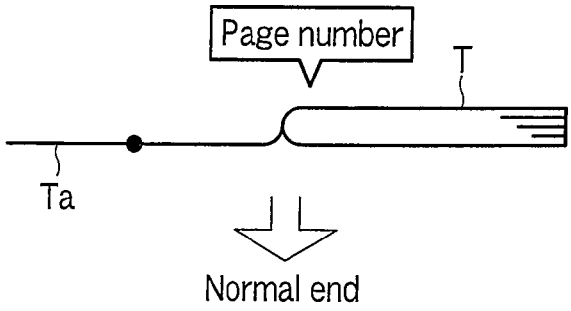
FIG. 43D is a diagram showing the page turning operation.
Figure 44A:
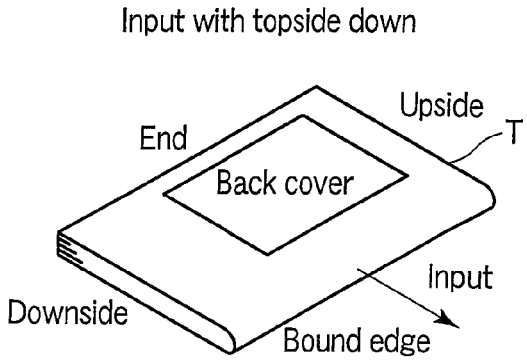
FIG. 44A is a diagram showing the operation of turning pages of a booklet input topside down.
Figure 44B:
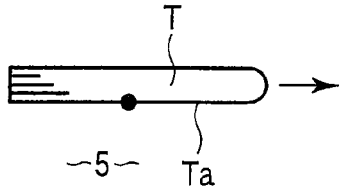
FIG. 44B is a diagram showing the page turning operation.
Figure 44C:
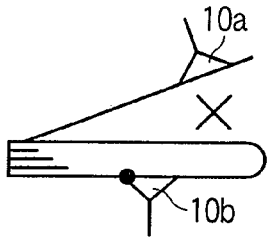
FIG. 44C is a diagram showing the page turning operation.

When the booklet T is input as shown in FIG. 43A and conveyed to the page turning position 5 as shown in FIG. 43B, the pages of the booklet T are turned clockwise at the page turning position 5 by the vacuum pad 10*a* as shown in FIG. 44C, and the page number detection sensor 24 reads the turned page number as shown in FIG. 43D. When the read value coincides with the turned page specified by the control unit 40, the page turning operation is normally finished. If the read value is different due to turning two or more pages at a time, the pages are turned back to the normal page.

FIGS. 44A to 44E show the operation of handling the booklet T, which is input topside down.

When the booklet T is input as shown in FIG. 44A and conveyed to the page turning position 5 as shown in FIG. 44B, the pages of the booklet T are turned clockwise at the page turning position 5 by the vacuum pad 10*a* as shown in FIG. 44C, as when the booklet is input in the normal conditions, but the bound edge side is tried to be picked up, and the booklet T is pulled by both upper-side and lower-side vacuum pads 10*a* and 10*b*.

Here, the vacuum pads 10 and 10*b* are in the following relationship.

$$\Sigma spfp<\Sigma SqFq$$

s and S: Distance between the axle of rotation in the pickup operation and each vacuum pad f and F: Suction force of the vacuum pad A lowercase character indicates the upper suction vacuum pad, and an uppercase character indicates the lower suction vacuum pad. The upper suction vacuum pad exists from 1 to p, and the lower suction vacuum pad exists from 1 to q. In this relationship, as a result of the pulling by the upper-side and lower-side vacuum pads 10*a* and 10*b*, the upper-side vacuum pad 10*a* certainly releases the booklet T.

Figure 44D:
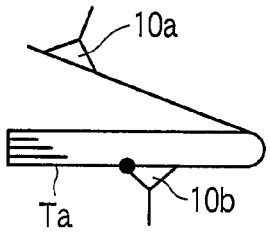
FIG. 44D is a diagram showing the page turning operation.
Figure 44E:
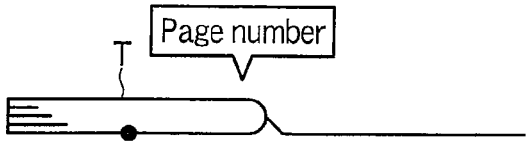
FIG. 44E is a diagram showing the page turning operation.

In this case, the control unit 40 determines that the input booklet T is bound at the right edge, turns the pages counterclockwise as shown in FIG. 44D, and reads the turned page number as shown in FIG. 44E.

If the page number can be read, the reading position of the page number detection sensor 24 coincides with the actual page number reading position, and the control unit 40 determines that the booklet T is not upside down.

Thereafter, the booklet is handled in two manners.

In a first manner, the opened page of the booklet T is turned down as shown in FIG. 45A, and the booklet T is reversed as shown in FIG. 45B, returned to the step of FIG. 43B, and handled by the subsequent steps.

In a second manner, the body paper Tc is turned back as shown in FIG. 46A, and the page number reading shown in FIG. 46B is repeated until the normal turned page. If a booklet has many pages, the second manner takes time.

FIGS. 47A to 47E show the operation of handling the booklet T, which is input upside down.

Figure 47A:
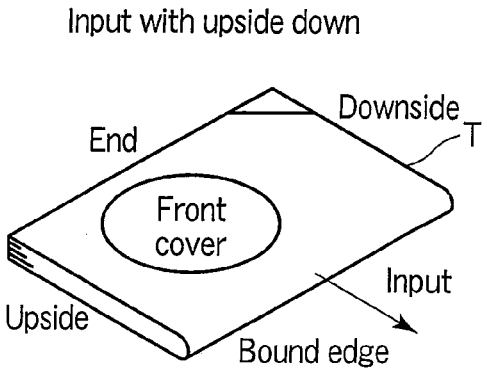
FIG. 47A is a diagram showing the operation of turning pages of a booklet input upside down.
Figure 47B:
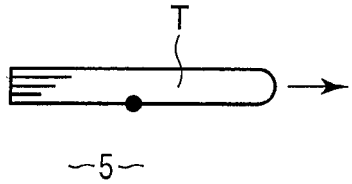
FIG. 47B is a diagram showing the page turning operation.
Figure 47C:
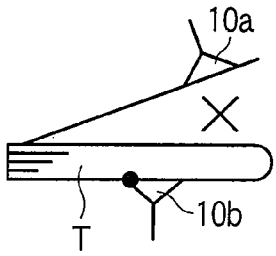
FIG. 47C is a diagram showing the page turning operation.
Figure 47D:
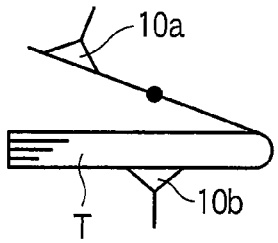
FIG. 47D is a diagram showing the page turning operation.
Figure 47E:
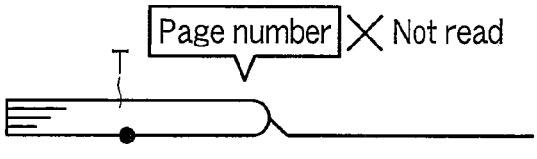
FIG. 47E is a diagram showing the page turning operation.
Figure 48A:
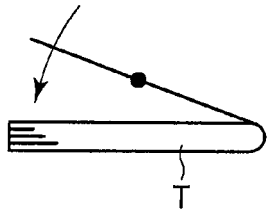
FIG. 48A is a diagram showing the page turning operation.

When the booklet T is input as shown in FIG. 47A and conveyed to the page turning position 5 as shown in FIG. 47B, the pages of the booklet T are turned clockwise at the page turning position 5 by the vacuum pad 10*a* as shown in FIG. 47C, as in the case where the booklet is input in the normal conditions, but the bound edge side is tried to be picked up, and the booklet T is pulled by both upper-side and lower-side vacuum pads 10*a* and 10*b*. In this case, as described above, the upper-side vacuum pad 10*a* certainly releases the booklet T. The control unit 40 determines that the input booklet T is bound at the right edge, turns the pages counterclockwise as shown in FIG. 47D, and reads the turned page number as shown in FIG. 47E. As the booklet T is turned upside down, the reading position of the page number detection sensor 24 is different from the actual page number reading position, and the page number cannot be read. Thus, the control unit 40 determines that the booklet T is upside down, and turns down the opened page of the booklet T as shown in FIG. 48A, and then reverses the booklet to the normal side.

Figure 48B:
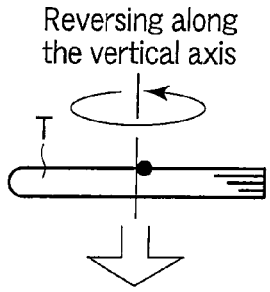
FIG. 48B is a diagram showing the page turning operation.
Figure 48C:
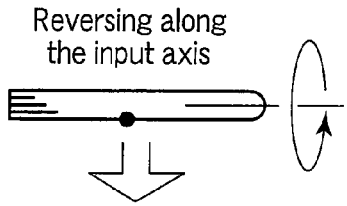
FIG. 48C is a diagram showing the page turning operation.

The booklet T can be reversed to the normal side in two manners. In a first manner, the booklet is reversed by turning about a vertical axis as shown in FIG. 48B. In a second manner, the booklet is reversed by turning about an input axis as shown in FIG. 48C. Either manner is permitted. However, the attitude after the reversing is different in the manners shown in FIG. 48B and FIG. 48C. When the booklet is reversed in the manner shown in FIG. 48B, the booklet is returned to the step of FIG. 43C, and handled by the subsequent steps. When the booklet is reversed in the manner shown in FIG. 48C, the booklet is returned to the step of FIG. 43C through the step of FIG. 45B, and handled by the subsequent steps.

FIGS. 49A to 49D show the operation of handling the booklet T, which is input upside down and top side down.

Figure 49A:
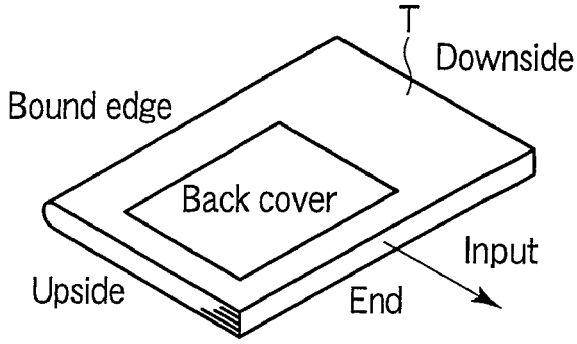
FIG. 49A is a diagram showing the operation of turning pages of a booklet input topside down and upside down.
Figure 49B:
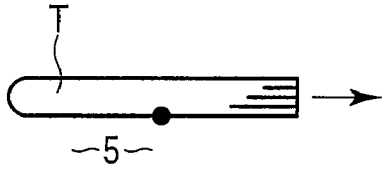
FIG. 49B is a diagram showing the page turning operation.
Figure 49C:
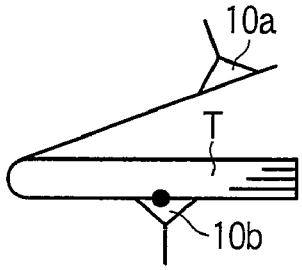
FIG. 49C is a diagram showing the page turning operation.
Figure 49D:
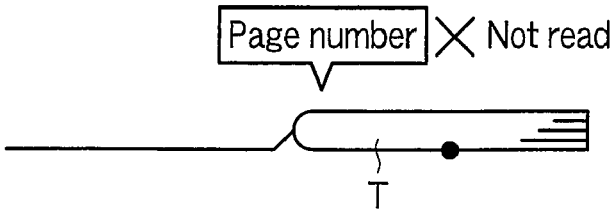
FIG. 49D is a diagram showing the page turning operation.

When the booklet T is input as shown in FIG. 49A and conveyed to the page turning position 5 as shown in FIG. 49B, the pages of the booklet T are turned clockwise at the page turning position 5 as shown in FIG. 49C, and the turned page number is read by the page number detection sensor as shown in FIG. 43D. At this time, as the booklet T is upside down, the reading position of the page number detection sensor 24 is different from the actual page number reading position, and the page number cannot be read. Thus, the control unit 40 determines that the booklet T is upside down, turns down the opened page, and then turns the booklet to the normal side.

Figure 50A:
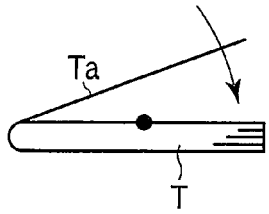
FIG. 50A is a diagram showing the page turning operation.
Figure 50B:
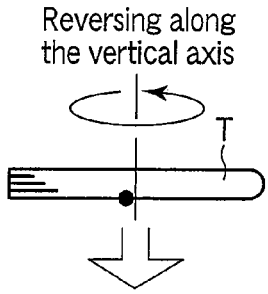
FIG. 50B is a diagram showing the page turning operation.
Figure 50C:
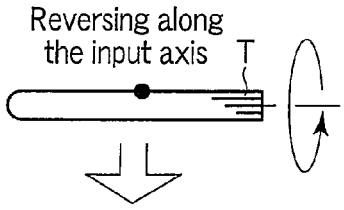
FIG. 50C is a diagram showing the page turning operation.

The booklet T can be reversed to the normal side in two manners. In a first manner, the booklet is reversed by turning about a vertical axis as shown in FIG. 50B. In a second manner, the booklet is reversed by turning about an input axis as shown in FIG. 50C. Either manner is permitted. However, the attitude after the reversing is different in the manners shown in FIG. 50B and FIG. 50C. When the booklet is reversed in the manner shown in FIG. 50B, the booklet is returned to the step of FIG. 43C through the step of FIG. 45B, and handled by the subsequent steps. When the booklet is reversed in the manner shown in FIG. 50C, the booklet is returned to the step of FIG. 43C, and handled by the subsequent steps.

According to the above two manners, the booklet T can be automatically handled to the normal page turning operation, even if the booklet T is input in any conditions.

In addition to the above two manners, separate exclusive sensors may be used to detect upside-down and topside-down of the booklet T. For example, an image of a whole front cover of a booklet is captured to detect upside-down and topside-down of the booklet, and reverse the booklet to normal conditions.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A page turning apparatus comprising:

a conveying device to covey a booklet to a page turning position;

a vacuum pad to vacuum suck the uppermost page of the booklet conveyed to a page turning position by the conveying device;

a driving device to move the vacuum pad to pick up the uppermost page of the booklet at a predetermined angle in the opening direction around a bound edge;

a contact roller to go under the uppermost page raised at a predetermined angle; and a control device which releases the vacuum suction of the vacuum pad, and moves the vacuum pad in the direction of retreating from the uppermost page after the contact roller goes under the uppermost page, and conveys the booklet so that the uppermost page is brought into contact with the contact roller, and opened.

2. The booklet page turning apparatus according to claim 1, wherein the conveying device has a conveying roller, and the contact roller is a pinch-roller to contact and separates from the conveying roller.

3. The booklet page turning apparatus according to claim 1, wherein the vacuum pad is provided on the upper side and lower side of the booklet conveying path, and the lower side of a booklet conveyed to the page turning position is sucked and held by the lower-side vacuum pad, and the uppermost page side is sucked and picked up by the upper-side vacuum pad.

4. The booklet page turning apparatus according to claim 1, wherein the driving device has a drive link plate, the upper-side vacuum pad is supported by a support rack having a guide ring, and the guide ring of the support rack is moved along a cam groove of a guide plate by turning the drive link plate, and the upper-side vacuum pad is moved between a sucking position and a retreating position.

5. A page turning apparatus comprising:

a conveying device to covey a booklet to a page turning position;

a vacuum pad to vacuum suck the uppermost page of the booklet conveyed to a page turning position by the conveying device;

a driving device to move the vacuum pad to pick up the uppermost page of the booklet at a predetermined angle in the opening direction around a bound edge;

a first contact roller to go under the uppermost page raised at a predetermined angle, and a second contact roller provided in the upstream of the booklet conveying direction of the first contact roller; and a control device which releases the vacuum suction of the vacuum pad, and moves the vacuum pad in the direction of retreating from the uppermost page after the first contact roller goes under the uppermost page, and conveys the booklet so that the uppermost page is brought into contact with the first contact roller, and opened, wherein the control device conveys the booklet in the reverse direction to locate the uppermost page at a page turning position, after the uppermost page of the booklet is opened, controls the vacuum pad to suck the uppermost page conveyed to the page turning position, moves the vacuum pad to turn and pick up the uppermost page at a predetermined angle in the opening direction around a bound edge, causes the second contact roller to go under the uppermost page picked up at a predetermined angle, releases the vacuum suction of the vacuum pad and moves the vacuum pad in the direction of retreating from the uppermost page, after the second contact roller goes under the uppermost page, and conveys the booklet in the reverse direction so that the uppermost page is brought into contact with the contact roller, and opened.

6. A page turning apparatus comprising:

a conveying device to covey a booklet to a page turning position;

a vacuum pad to vacuum suck the uppermost page of the booklet conveyed to a page turning position by the conveying device;

a driving device to move the vacuum pad to pick up the uppermost page of the booklet at a predetermined angle in the opening direction around a bound edge;

a first contact roller to go under the uppermost page raised at a predetermined angle, and a second contact roller provided in the upstream of the booklet conveying direction of the first contact roller; and a control device which releases the vacuum suction of the vacuum pad, and moves the vacuum pad in the direction of retreating from the uppermost page after the first contact roller goes under the uppermost page, and conveys the booklet so that the uppermost page is brought into contact with the first contact roller, and opened; and a detection device to detect the page number of the opened uppermost page, wherein when the page number detected by the detection device is different from the page number of the uppermost page, the control device repeats the opening operation, and when the uppermost page of the booklet is correctly opened, the control device conveys the booklet in the reverse direction to locate the uppermost page at a page turning position, controls the vacuum pad to suck the uppermost page conveyed to the page turning position, moves the vacuum pad to turn and pick up the uppermost page at a predetermined angle in the opening direction around a bound edge, causes the second contact roller to go under the uppermost page picked up at a predetermined angle, releases the vacuum suction of the vacuum pad and moves the vacuum pad in the direction of retreating from the uppermost page, after the second contact roller goes under the uppermost page, and conveys the booklet in the reverse direction so that the uppermost page is brought into contact with the contact roller, and opened.

* * * * *